US011585161B2

(12) United States Patent
Wetzel

(10) Patent No.: US 11,585,161 B2
(45) Date of Patent: Feb. 21, 2023

(54) WET MATE CONNECTOR FOR AN ELECTRIC SUBMERSIBLE PUMP (ESP)

(71) Applicant: James R Wetzel, Richmond, TX (US)

(72) Inventor: James R Wetzel, Richmond, TX (US)

( * ) Notice: Subject to any disclaimer, the term of this patent is extended or adjusted under 35 U.S.C. 154(b) by 0 days.

(21) Appl. No.: 17/499,944

(22) Filed: Oct. 13, 2021

(65) Prior Publication Data

US 2022/0178212 A1 Jun. 9, 2022

Related U.S. Application Data

(60) Provisional application No. 63/122,044, filed on Dec. 7, 2020.

(51) Int. Cl.
*E21B 17/02* (2006.01)
*E21B 43/12* (2006.01)

(52) U.S. Cl.
CPC ..... *E21B 17/028* (2013.01); *E21B 43/128* (2013.01)

(58) Field of Classification Search
CPC .... E21B 17/028; E21B 43/128; H01R 13/523
See application file for complete search history.

(56) References Cited

U.S. PATENT DOCUMENTS 7,533,461 B2 5/2009 Griffith
8,485,837 B2 7/2013 Head
8,546,527 B2 10/2013 Deber et al.
8,746,354 B2 6/2014 Head
8,816,196 B2 8/2014 Williams et al.
8,950,476 B2 2/2015 Head
9,028,264 B2 5/2015 Head
9,197,006 B2 11/2015 Hack
9,270,051 B1 2/2016 Christiansen et al.
9,322,252 B2 4/2016 Head
9,419,362 B2 8/2016 Lin
9,556,686 B1 1/2017 Krumpe
9,647,381 B2 5/2017 Head
9,941,622 B1 4/2018 Campbell
10,267,097 B2 4/2019 Mendez et al.
10,276,969 B2 4/2019 Campbell
10,533,381 B2 1/2020 Head et al.
10,605,056 B2 3/2020 Hartley
10,693,251 B2 6/2020 Ross et al.
11,021,939 B2 6/2021 Crowley et al.
(Continued)

*Primary Examiner* — Michael R Wills, III
(74) *Attorney, Agent, or Firm* — Ritchison Law Offices PC; John D Ritchison

(57) ABSTRACT

A method for making a wet mate electrical connection in an underground borehole with a static downhole conductor pin that is protected from the borehole environment by a non-sealed shuttle and a moveable mating receptacle/conductor which presses on the outer body of the shuttle thus causing it to move along the conductor pin tube. The conductor pin inserts into the receptacle connector and connects to the contacts. Both connectors are filled with a dielectric fluid for isolation and are pressure balanced to counteract volume variation due to temperature changes. The moveable receptacle connector uses a non-conductive pin which is replaced by the conductor pin and provides a surface for wiper seals. As mating occurs, the conductor pin replaces the non-conductive pin, so no volume change occurs, and pressure change is eliminated. A reverse labyrinth isolates the heavy dielectric of the static connector from borehole fluid.

15 Claims, 18 Drawing Sheets

Rig Less Deployment System Components

(56) References Cited

U.S. PATENT DOCUMENTS

| | | | | |
|---|---|---|---|---|
| 2014/0030904 | A1* | 1/2014 | Head | H01R 13/523<br>439/283 |
| 2017/0204680 | A1* | 7/2017 | Leismer | H01R 13/005 |
| 2021/0140247 | A1 | 5/2021 | Bishop et al. | |

* cited by examiner

Wet mate connector positions on motor connector

Wet mate connector positions on docking station connector

Rig Less Deployment System Components

Female wet mate

Connector cutaway

Female connector cross section

Connector in main body

Partial cutaway of connector housing

Shuttle body and conductor conduit assemblies

Expanded View

Note: 5A Conductor conduit 53 with conductor 55

Shuttle body labyrinth path

Flat pattern of internal labyrinth path

Top view shuttle body 84

Male Wet Mate Connector Oil Path

Vertical pathways are numbered 1 though 5 to show the pathway connection from view to view Vertical pathways are numbered 1 through 5 to show the pathway connection from view to view Shuttle pin assembly
In conductor housing Shuttle Pin Assembly Shuttle pin to conductor conduit connection Expanded View Male wet mate connector
cross section Mated connectors cross section Alternative Pressure Balance Cross Section of Alternative Pressure Balance

VIEW A

VIEW B

US Patent 9,028,264
Downhole Electrical Connector
2015 - Head

US Patent 8,746,354
Wet Connection System
For Downhole Equipment
2014 - Head

US Patent 10,276,969
Connector w/ Sealing Boot
& Moveable Shuttle
2019 - Campbell US Patent 7,533,461
Method for Interconnecting Conduits
In a Borehole
20009 - Griffiths

204

US Patent 9,270,051
Wetmate Connector
2016 – Christianson et al

206

US Patent 9,556,686
Wet-Mateable Connector Unit
w/Gas Pressure Relief
2017 - Krumpe

205

US Patent 9,546,527
Wet Connection System
For Downhole Equipment
2017 - Head

207

US Patent 8,485,837
Electrical Wet Connector
In Downhole Environment
2013 - Head

208

US Patent 11,021,939
System and method related
to pumping fluid in a borehole
2021 - Crowley, et al.

WET MATE CONNECTOR FOR AN ELECTRIC SUBMERSIBLE PUMP (ESP)

CROSS-REFERENCE TO RELATED APPLICATIONS

This application claims the benefit of U.S. Provisional Patent Application with Ser. No. 63/122,044 filed Dec. 7, 2020, by James R. Wetzel. The application is entitled "Wet Mate Connector for an Electrical Submersible Pump (ESP)".

FIELD OF INVENTION

This invention relates to a method and system for making an electrical connection in an underground borehole that provides for the transmission of electric power from a power supply to the motor of an electric submersible pump (ESP). This invention relates to wet connectors for downhole use, which is to say, releasable connectors for electrical conductors which can be made and unmade in the fluid environment of a wellbore, particularly but not exclusively a hydrocarbon well. The field of the invention relates generally to wet mate connectors installed in downhole environments, and more particularly to a receptacle connector effectively engaged with a mating plug connector.

This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to electrical connections for conductors in a downhole environment, particular connections that are engageable and releasable downhole.

FEDERALLY SPONSORED RESEARCH

None.

SEQUENCE LISTING OR PROGRAM

None.

BACKGROUND—FIELD OF INVENTION AND PRIOR ART

As far as known, there are no Wet Mate Connector for an Electric Submersible Pump (ESP) or the like. It is believed that this product is unique in its design and technologies.

BACKGROUND

This invention relates to a method for making an electrical connection in an underground borehole that provides for the transmission of electric power from a power supply to the motor of an electric submersible pump (ESP). The electrical connectors have features that provide a balance of pressure between the internal dielectric fluid and the external borehole fluid. The moveable connector is mounted to the electric motor of a submersible pump. The dielectric fluid of the connector is in contact with the dielectric fluid of the electric motor. The submersible pump includes a protector that performs the function of providing a pressure balance between the dielectric fluid and the borehole fluids. The static connector includes a labyrinth pathway above the conductor mating surface that is filled with a high specific gravity dielectric fluid. The end of the pathway is open to the borehole fluids providing a pressure balance between the dielectric fluid within the connector.

An Electric Submersible Pump (ESP) is often used to lift fluids from a well. The operation of this system requires the pump to be submersed in the fluid. The pump operates in a harsh environment with high pressure and temperature. The main components of the fluid are oil and salt water but may also contain gases ($CO_2$ and $H_2S$) that make it highly corrosive and electrically conductive. To lower the cost of workovers to replace the pumps when they fail systems have been developed that will allow for the electrical power system to remain in the well while the ESP is removed and replaced via wireline, coiled tubing or sucker rods. To facilitate this operation, it is required for the ESP to make an electrical connection in the down hole environment. The electrical connection must be able to isolate the conductors from the harsh fluid environment. Current technology in this field utilize more complicated systems for balancing the pressure during the connection.

This background as to Electric Submersible Pumps and their connection to electrical power should be useful. An oil or gas well may use many types of apparatus that require an electric connection, such as tools and measuring devices that are lowered down the well, and equipment that is installed or present in a casing or production tube. Electrical power for these tools is usually supplied through a conductive line from the surface extending from the tool to the surface. Usually, an oil or gas well will be lined with tubing that is cemented into the borehole to form a permanent well casing, the inner surface of the tubing defining the wellbore. (In this specification, a "tube" or "tubing" means an elongate, hollow element which is usually but not necessarily of circular cross-section, and the term "tubular" is to be construed accordingly.) The fluid produced from the well is ducted to the surface via production tubing which is usually deployed down the wellbore in jointed sections and (since its deployment is time consuming and expensive) is preferably left in situ for the productive life of the well. Where an ESP is used to pump the well fluid to the surface, it may be permanently mounted at the lower end of the production tubing, but is more preferably deployed by lowering it down inside the production tubing on a wireline or on continuous coiled tubing (CT), so that it can be recovered without disturbing the production tubing.

In some cases, an electrically submersible pump (ESP) is installed in wells to increase the production of hydrocarbon fluid from a well. In general, an ESP is an "artificial lift" mechanism that is typically positioned relatively deep within the well where it is used to pump the hydrocarbon fluid to the surface. However, installation of an ESP on an existing well can be very expensive for several reasons. First, installation of an ESP on an existing well requires that the completion be pulled and replaced with a completion that is designed for and includes the ESP. Second, such workover operations require the use of expensive vessels (e.g., ships or rigs) to re-complete the well, given the equipment that must be removed from the well during these workover operations. Even in the case where the well initially included an ESP, or where one was later added to the well, such ESPs do malfunction and need to be replaced. Thus, even in this latter situation, expensive vessels must be employed in replacing previously installed ESPs.

Sometimes a conductive line must be disposed down the well to attach to the tool, rather than the tool being lowered with the conductive line already attached. There are many reasons why the conductive line is not always installed simultaneously with the tool; the tool may have been installed with or incorporated in the casing or production tube, or it may be convenient to install a particular tool down a casing or production line without an electric line, or an already attached electric line may have to be recovered due to a fault or to allow another tool access. To make an electric connection in this downhole environment, it must be ensured firstly that the lowered connector locates and engages securely with the installed connector, and further that well fluid and material suspended in the well fluid does not penetrate between the surfaces of the connectors to prevent or degrade the conduction between the connection. Ideally, the connection should be reversible without damaging the connectors, allowing the lowered connection to be released and removed from the well, and re-lowered and re-attached as many times as necessary.

In oil and gas well connector applications, the plug and receptacle units of wet-mate able downhole electrical connectors are mated and de-mated at a point downhole or subsea in order to releasably connect power or signal to downhole equipment such as pumps, sensors, or the like, with the connector units oriented vertically or at an angle. One of the connector units is connected to the downhole equipment while the other connector unit is at the end of a power supply or signal communication cable A wet connector typically comprises a male part comprising one or a group of plugs, and a female part comprising a corresponding number of sockets, the or each respective plug and socket having a single electrical contact or an array of contacts. Either the male or the female part may be arranged on the tool, with the other part being arranged on the power or signal line. For ESPs and other electrical tools running on a three phase power supply, the connector may comprise for example a single plug and socket having three axially spaced contacts, or a group of three plugs and sockets, each having a single electrical contact. To exclude wellbore fluids from the connector, it is usual to occlude the bore of the socket with a retractable insert which is displaced by the plug. The sliding interface between the socket and the insert is protected by one or a series of annular seals known as wiper seals, hereinafter also referred to as wipers, which slidingly wipe contaminants from the surface of the plug as it enters the socket. In practice it is found that as the plug enters the socket, contaminants clinging to the plug may travel past the or each wiper to form an electrically conductive path, leading to failure of the connector.

The prior art of wet mate able connectors utilizes an elastomeric bladder or series of bladders filled with dielectric fluid to provide for the pressure balancing during the mating function. As a result, there is a movement of the dielectric fluid during the mating function. The fluid movement is caused by the differential pressure across the bladders during the mating operation. Although this differential pressure is typically balanced very quickly the pressure differential becomes a function of the speed of insertion. In addition, the elastomeric bladder is susceptible to the penetration of the small gas molecules including hydrogen sulfide which can lead to shortened life of the connector.

PROBLEM SOLVED

The intention of this invention is to utilize a simpler method for pressure balancing that will reduce the cost of the system and make it more reliable. The invention proposes to use the pressure balance features of the ESP for the female connector. The male connector will be open to the bore hole fluids and will utilize a labyrinth filled with heavy dielectric fluid for pressure balancing. To further simplify the connection there will be no pressure change while mating. The improvement and problems solved as to a Wet Mate Connector for an Electric Submersible Pump (ESP include: no elastomeric bladders (not susceptible to gas migration); no pressure changes during connector mating; simpler design improves reliability with pressure balance of female connector achieved by communication with dielectric fluid of ESP eliminating redundant pressure balance systems; simpler design improves reliability with pressure balance of male connector utilizing heavy dielectric fluid that is in direct contact with the borehole fluids; and a configuration such that any fluid penetration that may occur during mating will be in the female connector which is retrievable.

PRIOR ART

It is believed that this product is unique in its design and technologies. A novelty search revealed:

A U.S. Pat. No. 7,533,461 entitled a Method for interconnecting electrical conduits in a borehole was issued to Griffiths in 2009.

B U.S. Pat. No. 9,028,264 is named a Downhole electrical wet connector and was issued to Head in 2015.

C U.S. Pat. No. 8,816,196 called Pressure balanced connector termination was issued to Williams, et al. in 2014.

D U.S. Pat. No. 9,197,006 titled Electrical connector having male and female contacts in contact with a fluid in fully mated condition was issued to Hack in 2015.

E U.S. Pat. No. 9,270,051 named a Wet mate connector was issued to Christiansen, et al. in 2016.

F U.S. Pat. No. 9,419,362 is called Electrical receptacle connector issued to Lin in 2016.

G U.S. Pat. No. 9,556,686 named Wet-mateable connector unit with gas pressure relief was issued to Krumpe in 2017.

H U.S. Pat. No. 9,941,622 named Connector with sealing boot and moveable shuttle was issued to Campbell in 2018.

I U.S. Pat. No. 10,267,097 called a Pressure compensating connector system, downhole assembly, and method was issued to Mendez, et al. in 2019.

J U.S. Pat. No. 10,276,969 named a Connector with sealing boot and moveable shuttle was issued to Campbell in 2019.

K U.S. Pat. No. 10,605,056 titled System for installing an electrically submersible pump on a well was issued to Hartley in 2020.

L U.S. Pat. No. 10,693,251 was named an Annular wet connector and issued to Ross, et al. in 2020.

M U.S. Pat. No. 8,485,837 called an Electrical wet connector in downhole environment was issued to Head in 2013.

N U.S. Pat. No. 8,746,354 is titled a Wet connection system for downhole equipment and issued to Head in 2014.

O U.S. Pat. No. 8,950,476 is called a Coiled tubing deployed ESP and was issued to Head in 2015.

P U.S. Pat. No. 9,322,252 named as a Fixed wet connection system for an electric submersible pump issued to Head in 2016.

Q U.S. Pat. No. 9,546,527 called a Wet connection system for downhole equipment again was issued to Head in 2017.

R U.S. Pat. No. 9,647,381 named Downhole electrical wet connector issued to Head in 2017.

S U.S. Pat. No. 10,533,381 is titled a Wet connection system for downhole equipment. Again, issued to Head, et al. in 2020.

T is a world patent WO0102699 called a METHOD OF DEPLOYING AN ELECTRICALLY DRIVEN FLUID TRANSDUCER SYSTEM IN A WELL. It issued to Smith in 2001.

U US Publication 20210140247 was named an ESP TUBING WET CONNECT TOOL and published for Bishop et al.

V U.S. Pat. No. 11,021,939 named a System and method related to pumping fluid in a borehole which was issued to Crowley, et al. in June, 2021. It shows and demonstrates a technique facilitates use of a submersible pumping system deployed downhole in a borehole. This docking assembly comprises a docking station which has at least one electrical wet connector and is coupled to a receiving tubular. An electrical power cable is coupled to the docking station to enable electrical power to be provided to the at least one electrical wet connector. The docking assembly is deployed downhole to a desired location in the borehole to enable coupling with the submersible pumping system. The submersible pumping system is simply moved downhole into the receiving tubular and into electrical engagement with the electrical wet connectors.

As can be observed, none of the prior art has anticipated or caused one skilled in the art of wetmate connection systems and methods for ESPs or the like to see this invention by Wetzel as obvious to a person skilled in the ordinary art of the industry. The Wet Mate Connector for an Electric Submersible Pump (ESP) solves many problems and is a unique system to address the needs for the oil well industry by providing a simple deployment and connection system which needs no special rigs or equipment to maintain the electrical submersible pumps. More description as to the unique characteristics associated with this application are explained below. For example, specific as to comparing the most recent U.S. Pat. No. 11,021,939, this application by Wetzel differs from Crowley, et al. in the orientation of the wet mate connectors and many other specific and novel features. See FIG. 12 detailed description, below. Advantages of Wetzel over Crowley, et al. include: a larger through, a smaller outside diameter (OD) of the motor connector that allows for a smaller ID of the production tubing which facilitates the ability to install a "456" ESP inside a standard seven-inch (7") casing; and a vertical alignment orientation that allows for the addition of wet mate connectors to drive other electrical components that may be incorporated in the well completion.

SUMMARY OF THE INVENTION

This invention is Wet Mate Connector for an Electric Submersible Pump (ESP). In accordance with some embodiments of the invention there is provided a method to interconnect electrical conductors in an underground borehole by means of a static male connector and a moveable female connector. The mating operation consists of aligning the center of the moveable connector contact with the conductor pin of the static connector then the moveable connector presses on the shuttle body of the static connector causing the outer body of the static connector to move axially along a guide tube containing the conductor. Concurrently, the conductor pin is pushed into the moveable connector and is mated to the electrical contact in the moveable connector. The travelling pin of the moveable connector is pushed out of the top of the moveable connector by the motion of the conductor pin.

The electrical connectors have features that provide a balance of pressure between the internal dielectric fluid and the external borehole fluid. The moveable connector is mounted to the electric motor of a submersible pump. The dielectric fluid of the connector is in contact with the dielectric fluid of the electric motor. The submersible pump includes a protector that performs the function of providing a pressure balance between the dielectric fluid and the borehole fluids. The static connector includes a labyrinth pathway above the conductor mating surface that is filled with a high specific gravity dielectric fluid. The end of the pathway is open to the borehole fluids providing a pressure balance between the dielectric fluid within the connector. The connectors also have wiper seals that act on the conductor pin of the static connector and the travelling pin of the moveable connector. During the mating and de-mating operations the wiper seals wipe any debris or fluid from the pins and provide a barrier between the dielectric fluid and the borehole fluid.

The preferred embodiment of a wet mate connector system that provides a pressure compensated environment for an inline electrical connection contact is comprised of: a). a set of several, at least one, but normally at least three inline male connectors, each connector that is static and remains in a borehole; b). a set of at least three inline female connectors, each connector that is moveable and is mounted on a motor connector that is part of the electric submersible pump (ESP) assembly; and c). each of the static male connectors further comprises a shuttle body, a shuttle pin, a return spring, and a conductor conduit, wherein the shuttle body comprises a series of wiper seals separated by seal spacers and a top and bottom seal retainer, wherein the top and bottom seal retainers are sealed to the shuttle body with an O-ring, and wherein the shuttle body profile includes a cylindrical body with a wedge-shaped abutment and which said cylindrical body contains the top and bottom seal retainer, the wiper seals and seal spacers wherein within the wet mate connector system, the shuttle pin is positioned at the center of this cylindrical body, and the cylindrical body of the shuttle is positioned inside the inside diameter of the docking station with its outside diameter tangential to the inside diameter of the docking station.

The newly invented Wet Mate Connector for an Electric Submersible Pump (ESP) may be manufactured at low volumes by very simple means and in high volume production by more complex and controlled systems.

OBJECTS AND ADVANTAGES

There are several objects and advantages of the Wet Mate Connector for an Electric Submersible Pump (ESP) including:

| Item | Advantages |
|---|---|
| 1 | No elastomeric bladders (not susceptible to gas migration) |
| 2 | No pressure changes during connector mating |
| 3 | Simpler design improves reliability with pressure balance of female connector achieved by communication with dielectric fluid of ESP eliminating redundant pressure balance systems |
| 4 | Simpler design improves reliability with pressure balance of male connector utilizing heavy dielectric fluid that is in direct contact with |

-continued

| Item | Advantages |
|---|---|
| | the borehole fluids |
| 5 | Any fluid penetration that may occur during mating will be in the female connector which is retrievable |

Finally, other advantages and additional features of the present Wet Mate Connector for an Electric Submersible Pump (ESP) will be more apparent from the accompanying drawings and from the full description of the device. For one skilled in the art of wet mate connections and downhole electrical interconnections for oil well applications and the like, it is readily understood that the features shown in the examples with this product are readily adapted to other types of oil well components and applications in the petroleum industry.

DESCRIPTION OF THE DRAWINGS—FIGURES

The accompanying drawings, which are incorporated in and constitute a part of this specification, illustrate an embodiment of the Wet Mate Connector for an Electric Submersible Pump (ESP) that is preferred. The drawings together with the summary description given above and a detailed description given below explain the principles of the wet mate connector system. It is understood, however, that the system as described and illustrated is not limited to only the precise arrangements and instrumentalities shown.

FIG. 1 A is a sketch of the wet mate connector positions on a motor connector and FIG. 1 B is a sketch of the wet mate connector positions on the docking station connector of a Rig Less Deployment System.

FIG. 2 A is a sketch of a female wet mate connector and FIG. 2 B is a sketch of a connector cutaway of the wet mate connector.

FIG. 3 A is a sketch of a female connector cross section and FIG. 3 B is a sketch of a Female Wet Mate Connector Dielectric Oil Path.

FIG. 4 A is a sketch of a wet mate connector in the main body and FIG. 4 B is a sketch of a partial cutaway of a male, inline connector housing.

FIG. 5 A is a sketch of a shuttle and conductor conduit assemblies and FIG. 5 B is a sketch of the expanded view of the shuttle and conductor assemblies.

FIG. 6 A is a sketch of a shuttle body labyrinth path, FIG. 6 B is a sketch of a flat pattern of internal labyrinth path, and FIGS. 6 C and 6 D are sketches of the Male Wet Mate Connector Dielectric Oil Path.

FIG. 7 A is a sketch of a shuttle pin assembly in the conductor housing and FIG. 7 B is a shuttle pin assembly.

FIG. 8 A is a sketch of a shuttle pin to conductor conduit connection and FIG. 8 B is an expanded view of the shuttle pin to conductor connection.

Figures 1A, 1B:
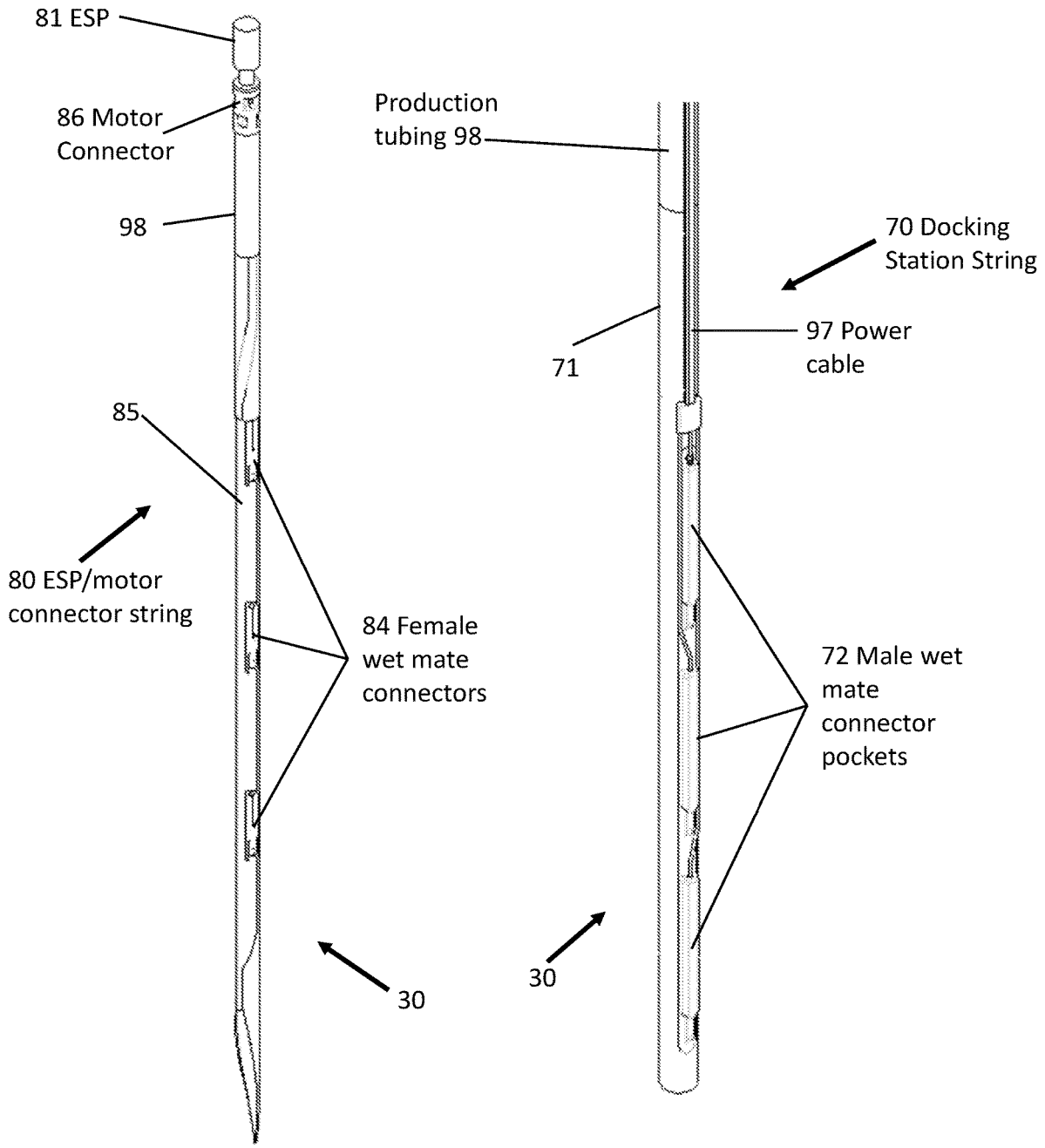

FIGS. 11 A and 11 B with the several views are schemes for alternative pressure balance for the dielectric fluids with cross sections and expanded views.

FIGS. 12 A through 12 I are sketches of prior art.

DESCRIPTION OF THE DRAWINGS—REFERENCE NUMERALS

The following list refers to the drawings:

TABLE B

Reference numbers

| Ref | Description |
|---|---|
| 30 | Electric Submersible Pump (ESP) Rig Less Deployment System 30 for Oil Wells and the like |
| 35 | Wet Mate Connector 35 for an Electric Submersible Pump (ESP) |
| 40 | return spring 40 |
| 41 | return spring cap 41 |
| 42 | seal retainer 42 |
| 43 | seal spacer 43 |
| 44 | wiper seals 44 |
| 45 | terminal 45 |
| 46 | insulator 46A, 46B, and an insulator tip 46C |
| 47 | O-ring 47 |
| 48 | electrical contact 48 |
| 49 | non-conductive travelling pin 49 with top head 49A and a tip 49C |
| 50 | conductor 50 |
| 51 | insulator 51 |
| 52 | combination 52 insulator 51 with conductor 50 |
| 53 | conduit 53 |
| 54 | conduit fitting 54 |
| 55 | assembly 55 of conductor 50 and conduit 53 |
| 57 | conductor guide tube 57 |
| 58 | alternative pressure balance configuration 58 |
| 60 | labyrinth path 60 |
| 62 | dielectric fluid 62 |
| 64 | epoxy 64 |
| 65 | grommet 65 |
| 70 | docking station string 70 |
| 71 | docking station tube 71 main body |
| 72 | male wet mate connector housing 72 |
| 80 | motor connector string 80 |
| 81 | electric submersible motor (ESP) 81 |
| 81A | connection head 81A for motor 81 |
| 84 | female wet mate connectors 84 housing on motor connector 80 |
| 84A | grooves 84A in wet mate connector 84 |
| 85 | connect mounting and partition plate 85 |
| 86 | motor connector 86 |
| 88 | discharge 88 |
| 89 | flow tube 89 |
| 94 | Shuttle body 94 |
| 97 | power cable 97 |
| 98 | production tubing 98 |
| 200 | Prior Art 200 U.S Pat. No. 9,028,264 - Downhole Electrical Connector - 2015 - Head |
| 201 | Prior Art 201 - U.S Pat. No. 8,746,354 - Wet Connection System for Downhole Equipment - 2014 - Head |
| 202 | Prior Art 202 - U.S Pat. No. 10,276,969 - Connector w/ Sealing Boot & Moveable Shuttle 2019 - Campbell |
| 203 | Prior Art 203 - U.S Pat. No. 7,533,461 - Method for Interconnecting Conduits in a Borehole - 20009 - Griffiths |
| 204 | Prior Art 204 - U.S Pat. No. 9,270,051 - Wetmate Connector - 2016 - Christianson et al |
| 205 | Prior Art 205 - U.S Pat. No. 9,546,527 - Wet Connection System for Downhole Equipment - 2017 - Head |
| 206 | Prior Art 206 - U.S Pat. No. 9,556,686 - Wet-Mate able Connector Unit w/Gas Pressure Relief - 2017 - Krumpe |
| 207 | Prior Art 207 - U.S Pat. No. 8,485,837 - Electrical Wet Connector in Downhole Environment 2013 - Head |
| 208 | Prior Art 208 - U.S Pat. No. 11,021,939 - System and method related to pumping fluid in a borehole 2021 - Crowley, et al |

DETAILED DESCRIPTION OF PREFERRED EMBODIMENT

The present development is a Wet Mate Connector for an Electric Submersible Pump (ESP). This invention relates to a method and system for making an electrical connection in an underground borehole that provides for the transmission of electric power from a power supply to the motor of an electric submersible pump (ESP). This invention relates to wet connectors for downhole use, which is to say, releasable connectors for electrical conductors which can be made and unmade in the fluid environment of a wellbore, particularly but not exclusively a hydrocarbon well. The field of the invention relates generally to wet mate connectors installed in downhole environments, and more particularly to a receptacle connector effectively engaged with a mating plug connector. This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed. This invention relates to electrical connections for conductors in a downhole environment, particular connections that are engageable and releasable downhole.

The advantages for the Wet Mate Connector 35 for an Electric Submersible Pump (ESP) 30 are listed above in the introduction. Succinctly the benefits are that the device:

A. No elastomeric bladders (not susceptible to gas migration);

B. No pressure changes during connector mating;

C. Simpler design improves reliability with pressure balance of female connector achieved by communication with dielectric fluid of ESP eliminating redundant pressure balance systems;

D. Simpler design improves reliability with pressure balance of male connector utilizing heavy dielectric fluid that is in direct contact with the borehole fluids; and E. A configuration such that any fluid penetration that may occur during mating will be in the female connector which is retrievable.

The preferred embodiment of a wet mate connector system 35 that provides a pressure compensated environment for an inline electrical connection contact is comprised of: a). a set of several at least one but normally three inline male connectors, each connector that is static and remains in a borehole; b). a set of at least three inline female connectors, each connector that is moveable and is mounted on a motor connector that is part of the electric submersible pump (ESP) assembly; and c). each of the static male connectors further comprises a shuttle body, a shuttle pin, a return spring, and a conductor conduit, wherein the shuttle body comprises a series of wiper seals separated by seal spacers and a top and bottom seal retainer, wherein the top and bottom seal retainer are sealed to the shuttle body with an O-ring, and wherein the shuttle body profile includes a cylindrical body with a wedge-shaped abutment and which said cylindrical body contains the top and bottom seal retainer, the wiper seals and seal spacers wherein within the wet mate connector system, the shuttle pin is positioned at the center of this cylindrical body, and the cylindrical body of the shuttle is positioned inside the inside diameter of the docking station with its outside diameter tangential to the inside diameter of the docking station.

There is shown in FIGS. 1-12 a complete description and operative embodiment of the Wet Mate Connector 35 for an Electric Submersible Pump (ESP). In the drawings and illustrations, one notes well that the FIGS. 1-12 demonstrate the general configuration and use of this product. The various example uses are in the operation and use section, below.

The accompanying drawings, which are incorporated in and constitute a part of this specification, illustrate an embodiment of the Wet Mate Connector 35 for an Electric Submersible Pump (ESP) that is preferred. The drawings together with the summary description given above and a detailed description given below explain the principles of the connector 35. It is understood, however, that the wet connector device 35 is not limited to only the precise arrangements and instrumentalities shown. Other examples of electrical connection devices for petroleum well systems and uses are still understood by one skilled in the art of components and oil well systems and the like to be within the scope and spirit shown here.

FIG. 1 A is a sketch of the wet mate connector positions on a motor connector and FIG. 1 B is a sketch of the wet mate connector positions on the docking station connector of a Rig Less Deployment System. The rig less deployment system shown comprises a docking station with wet mate able connectors and power cable and a motor connector that will be mated to an electric submersible pump (ESP). The docking station comprises a main body, wet mate able connectors and a power cable that is electrically connected to the wet mate able connectors and to a power source on the surface. The docking station will be hung at the bottom of a string of production tubing. The docking station will remain in the well for the life of the system. The motor connector will be mated to the bottom of an ESP and lowered into the well by wireline, coiled tubing, sucker rods or other suitable deployment method. The power connection between the docking station and the motor connector is facilitated by pairs of wet mate able connectors. The female connector is mounted to the motor connector and the male connector is mounted to the docking station. Seen here are specific references and their configurations that include: an Electric Submersible Pump (ESP) Rig Less Deployment System 30 for Oil Wells and the like; a docking station tube 71 main body; a male wet mate connector housing 72; a motor connector string 80; an electric submersible motor (ESP) 81; a female wet mate connectors 84 housing on motor connector 80; a motor connector 86; a flow tube 89; a power cable 97; and a production tubing 98.

Figures 2A, 2B:
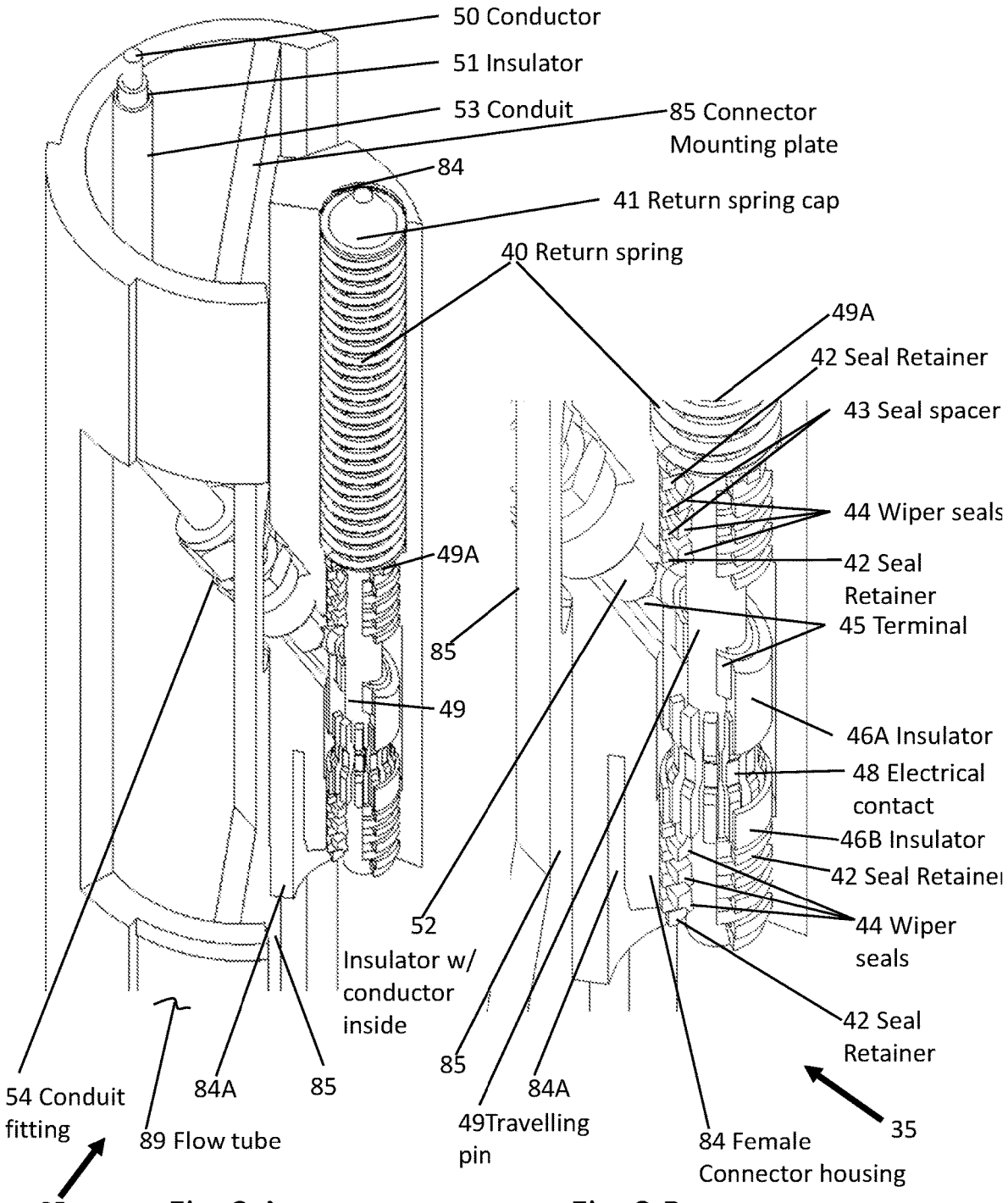

FIG. 2 A is a sketch of a female wet mate connector and FIG. 2 B is a sketch of a connector cutaway of the wet mate connector. These show the female connector cutaway views which comprises a housing that is mounted on a flow tube of the motor connector assembly, an electrical contact, a travelling pin, a return spring, and wiper seals. The female connector is electrically connected to the motor through a wire which is enclosed in a conduit. The tubing is also the conduit for dielectric fluid from the motor. The wiper seals acting on the travelling pin create a barrier to the borehole fluid. The several references and their respective configurations portrayed here are: a Wet Mate Connector 35 for an Electric Submersible Pump (ESP); a return spring 40; a return spring seal retainer 41; a seal retainer 42; a seal spacer 43; a wiper seals 44; a terminal 45; an insulator 46A, 46B; an electrical contact 48; a non-conductive travelling pin 49 with top head 49A; a conductor 50; an insulator 51; a combination 52 insulator 51 with a conductor 50; a conduit 53; a conduit fitting 54; a female wet mate connectors 84 housing on motor connector 80; mounting grooves 84A in wet mate connector 84; a connector mounting and partition plate 85; and a flow tube 89.

Further description of FIGS. 2 A and 2 B are that: the moveable female connector comprises a connector housing, an electrical contact with connected terminal, an insulator, upper and lower wiper seal sets with associated retainers and spacers, a return spring and cap, and a traveling pin. The connector is mounted to a mounting plate on the motor connector. A conductor conduit is joined to the connector housing with a tubing fastener (Swagelok or equivalent). The connector housing has an internal cylindrical cavity that holds the electrical contact, insulator, and wiper seal sets. The electrical contact is a highly conductive material that contacts the conductor of the male connector during the mating operation. In this embodiment of the invention, the contact force is maintained by a series of fingers that act as bow springs. An alternate configuration may use cantilevered fingers or a lattice shaped mesh contact. The electrical contact is oriented along the center axis of the internal housing cavity and slightly below the center. The contact is positioned between the upper and lower seal sets and is isolated from the connector housing by both an insulator and dielectric fluid. At the top of the electrical contact is an electrical terminal. The contact is joined to the terminal by press fit. The terminal is also isolated from the connector housing by the insulator and dielectric fluid. The wiper seal sets are also aligned with the axis of the cylindrical connector housing cavity. In one embodiment of this invention there are three wiper seals at the top of the shuttle body and three wiper seals at the bottom of the shuttle body. Two wiper seals are directed outward and one wiper seal is directed inward at each end of the travelling pin. The assembly of the seal sets require a seal retainer above and below each set of wiper seals. The wiper seals act on the travelling pin in the unmated condition. During the mating operation the travelling pin is pushed out of the top of the connector housing while the shuttle pin of the male connector is pushed into the female connector. The wiper seals act on both the travelling pin and the shuttle pin during this process. The travelling pin is positioned along the axis of the cylindrical cavity of the connector housing. The travelling pin extends below the lower seal set at its bottom and the top extends outside of the connector cavity in the connector housing. The bottom end of the travelling pin has an inverted cone shape to facilitate mating with the insulating tip of the shuttle pin during the mating process. The top of the travelling pin employs a cross shaped support for the return spring. The bottom of the cross shaped support will rest on the outside surface of the connector housing to form the stop when returning the travelling pin to the unmated position. The return spring is positioned in a cylindrical cavity of the connector housing that is open to the borehole fluids. The return spring is made of a corrosion resistant material. The bottom of the spring is supported by the travelling pin. The top of the spring is retained by the return spring cap. The return spring cap is conical in shape and performs the function of retaining the top of the spring while allowing fluid migration past the cap. The conical shape will serve to deflect debris from entering the return spring cavity. The return spring cavity may be filled with high specific gravity dielectric fluid or other high specific gravity fluid as an added barrier between the interior of the connector housing and the borehole fluid.

The electrical connection to the ESP or other electrical component is facilitated by the conductor conduit. The conductor conduit comprises an outer tube with an insulated wire and dielectric fluid inside. The conductor conduit outer tube is a corrosion resistant material that is connected to the connector housing at the bottom and the motor connector head at the top. The tube is joined with a tubing fastener (Swagelok or equivalent). In one embodiment of the invention the dielectric fluid in the inner cavity of the female connector is in direct contact with the dielectric fluid of the ESP motor. The fluid passage between the ESP motor and the female connector is through the head of the motor connector, through the discharge body of the motor connector and through the respective conductor conduits. The fluid occupies the space between the outside diameter of the conductor wire and the inside diameter of the tube and/or through hole of the respective bodies. The ESP motor incorporates a protector that creates a pressure balance between the external borehole fluid and the dielectric fluid within the motor. This pressure balance is maintained throughout the internal dielectric fluid of the female wet mate connector and the external borehole fluid.

Figure 3A:
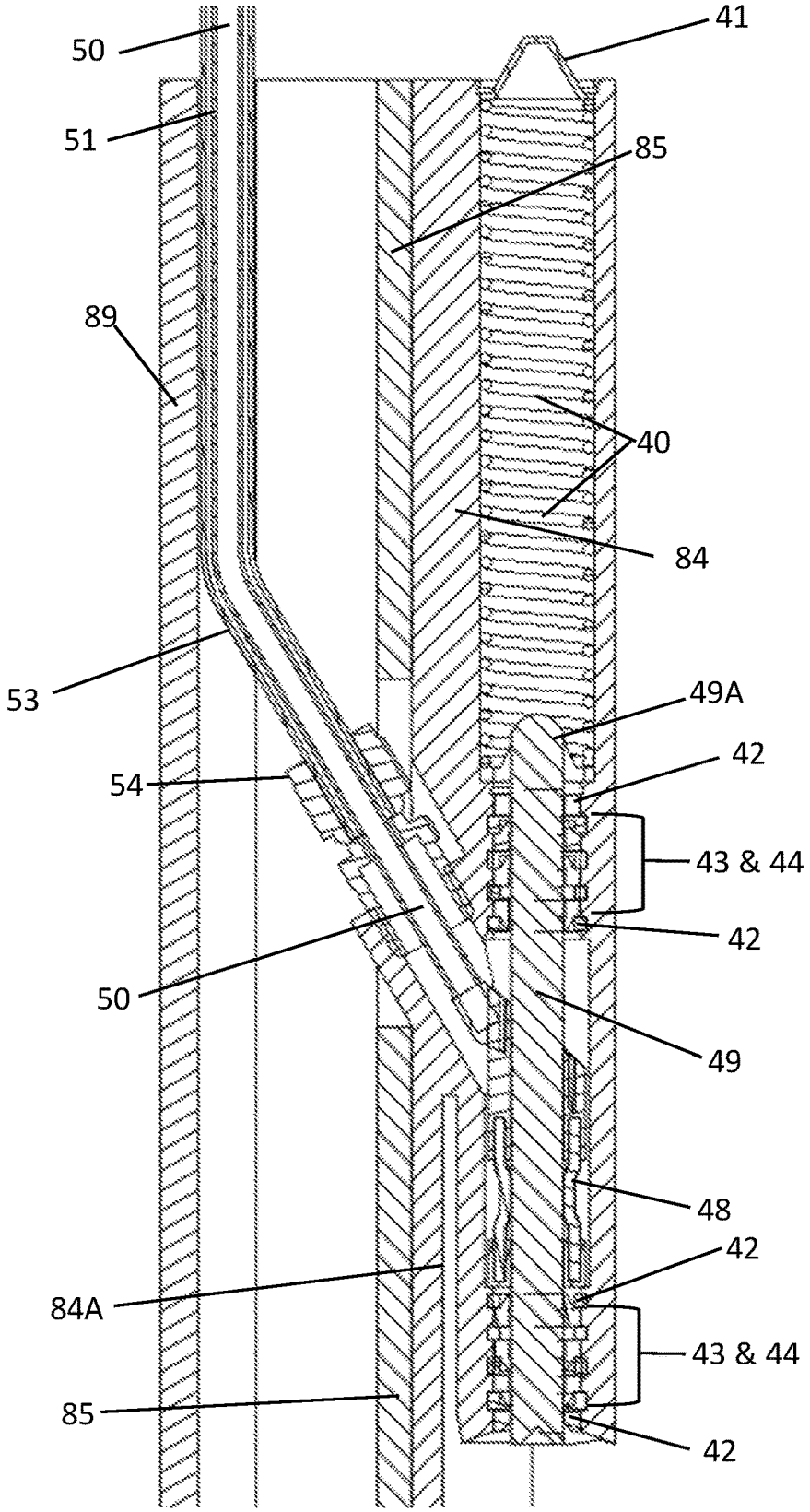
Figure 3B:
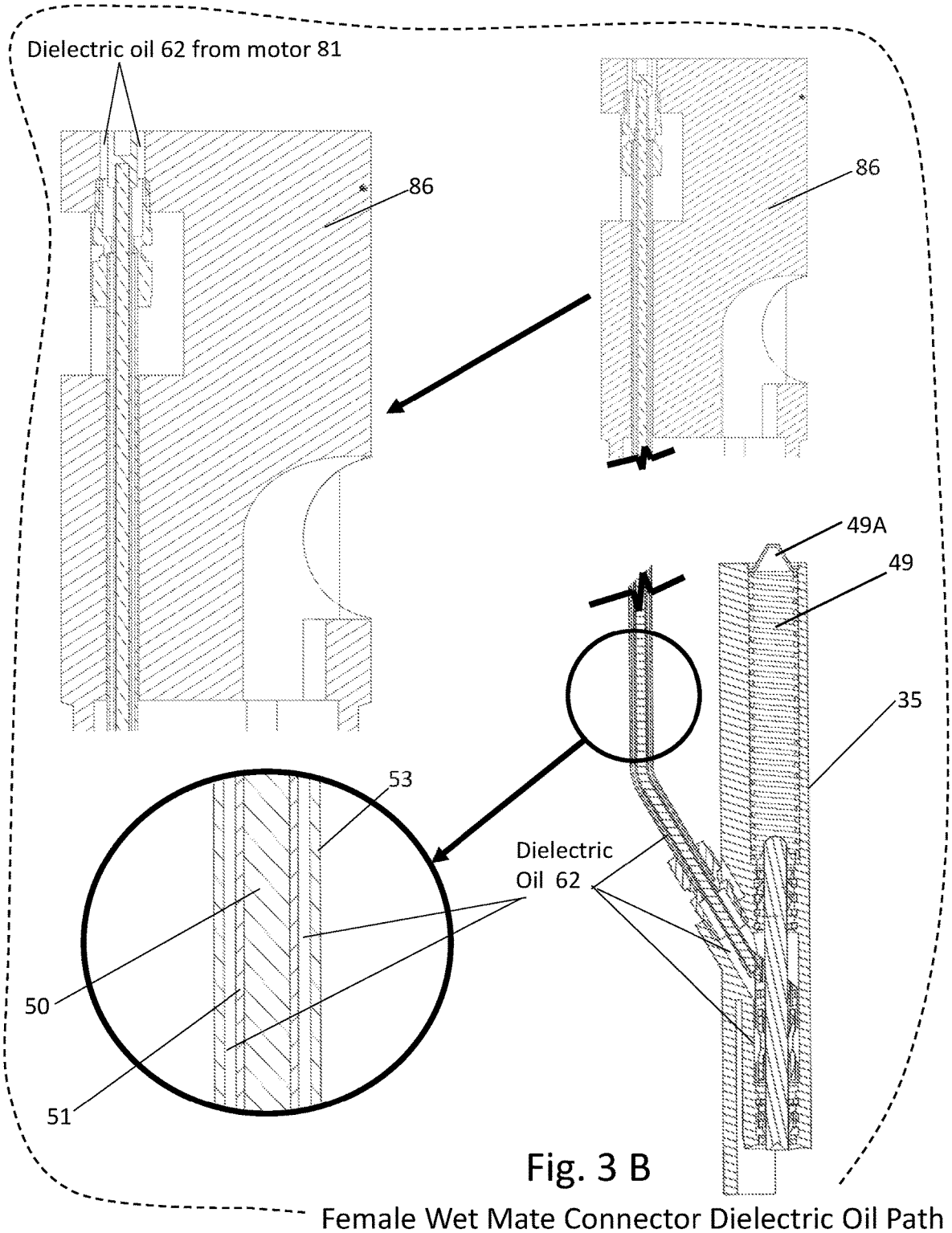

FIG. 3 A is a sketch of a female connector cross section and FIG. 3 B is a sketch of a Female Wet Mate Connector Dielectric Oil Path. Demonstrated in these views are: In FIG. 3 A is a return spring 40; a return spring cap 41; a seal retainer 42; a seal spacer 43; a wiper seals 44; an electrical contact 48; a non-conductive travelling pin 49 with top head 49A; a conductor 50; an insulator 51; a combination 52 insulator 51 with a conductor 50; a conduit 53; a conduit fitting 54; a female wet mate connectors 84 housing on motor connector 80; a mounting grooves 84A in wet mate connector 84; a connector mounting and partition plate 85; and a flow tube 89. And in FIG. 3 B are: a Wet Mate Connector 35 for an Electric Submersible Pump (ESP); a conductor 50; an insulator 51; a conduit 53; a dielectric fluid 62; an electric submersible motor (ESP) 81; and a motor connector 86.

Figure 4A:
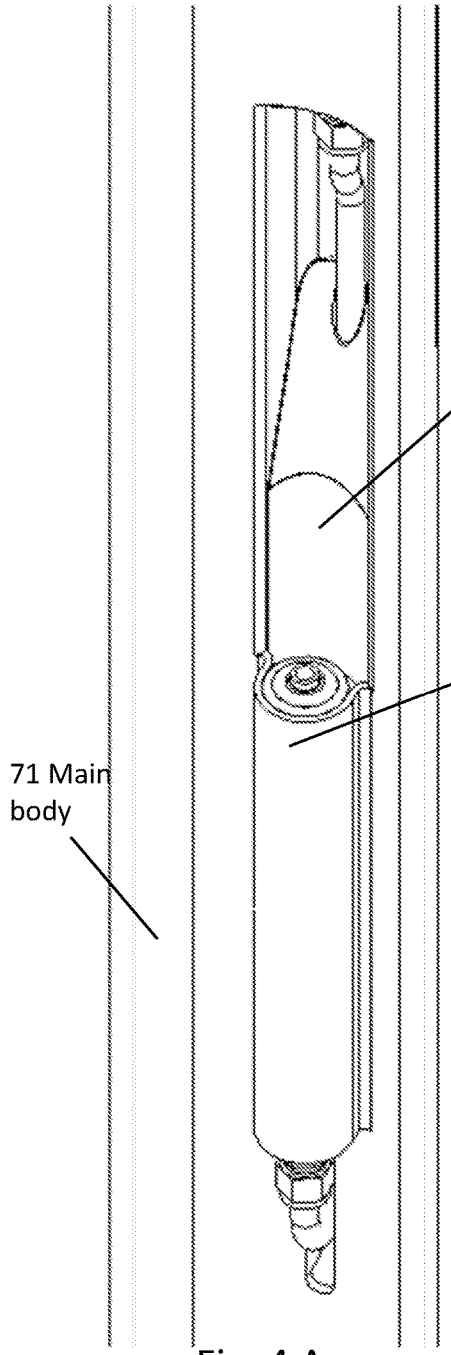
Figure 4B:
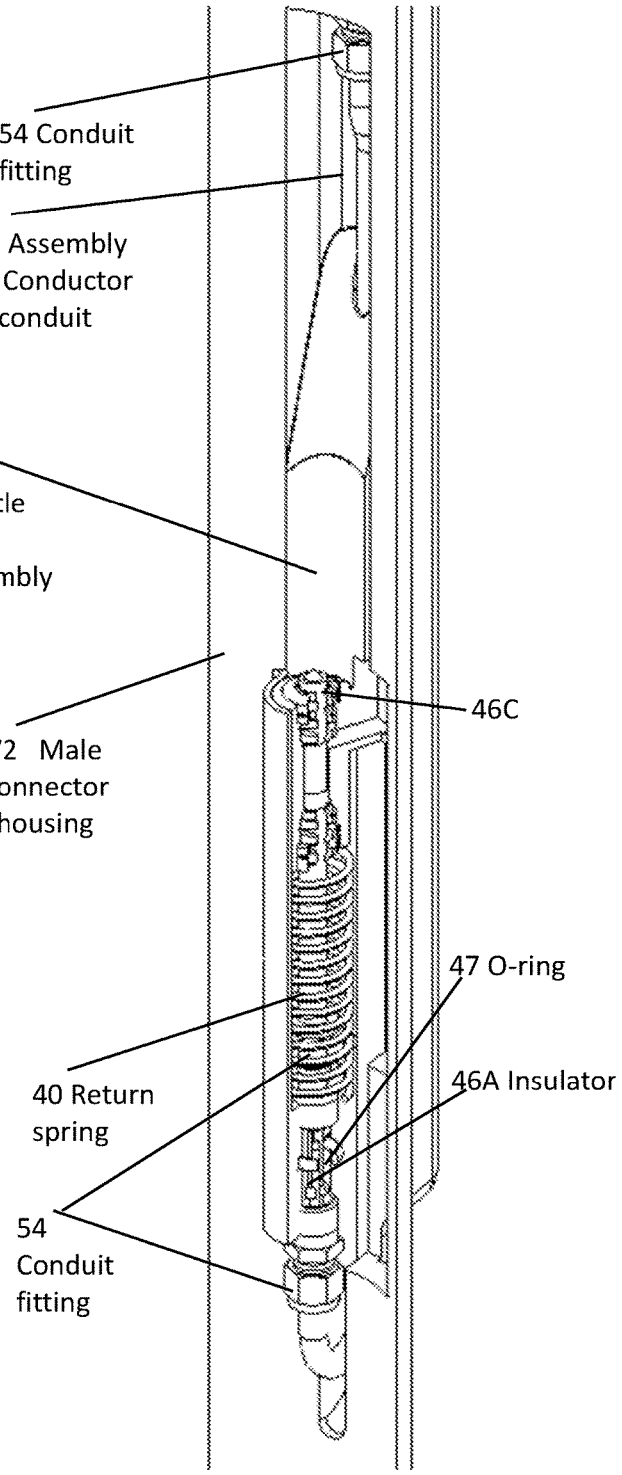

FIG. 4 A is a sketch of a wet mate connector in the main body and FIG. 4 B is a sketch of a partial cutaway of a male, inline connector housing. The male connector comprises a housing that is integral to the main body, a shuttle assembly, a shuttle pin assembly, a conductor conduit assembly and return spring as shown. Other references provided include: a return spring 40; an insulator 46A, 46B; an O-ring 47; a conduit fitting 54; an assembly 55 of a conductor 50 and a conduit 53; a docking station tube 71 main body; a male wet mate connector housing 72; and a Shuttle body 94.

Figures 5A, 5B:
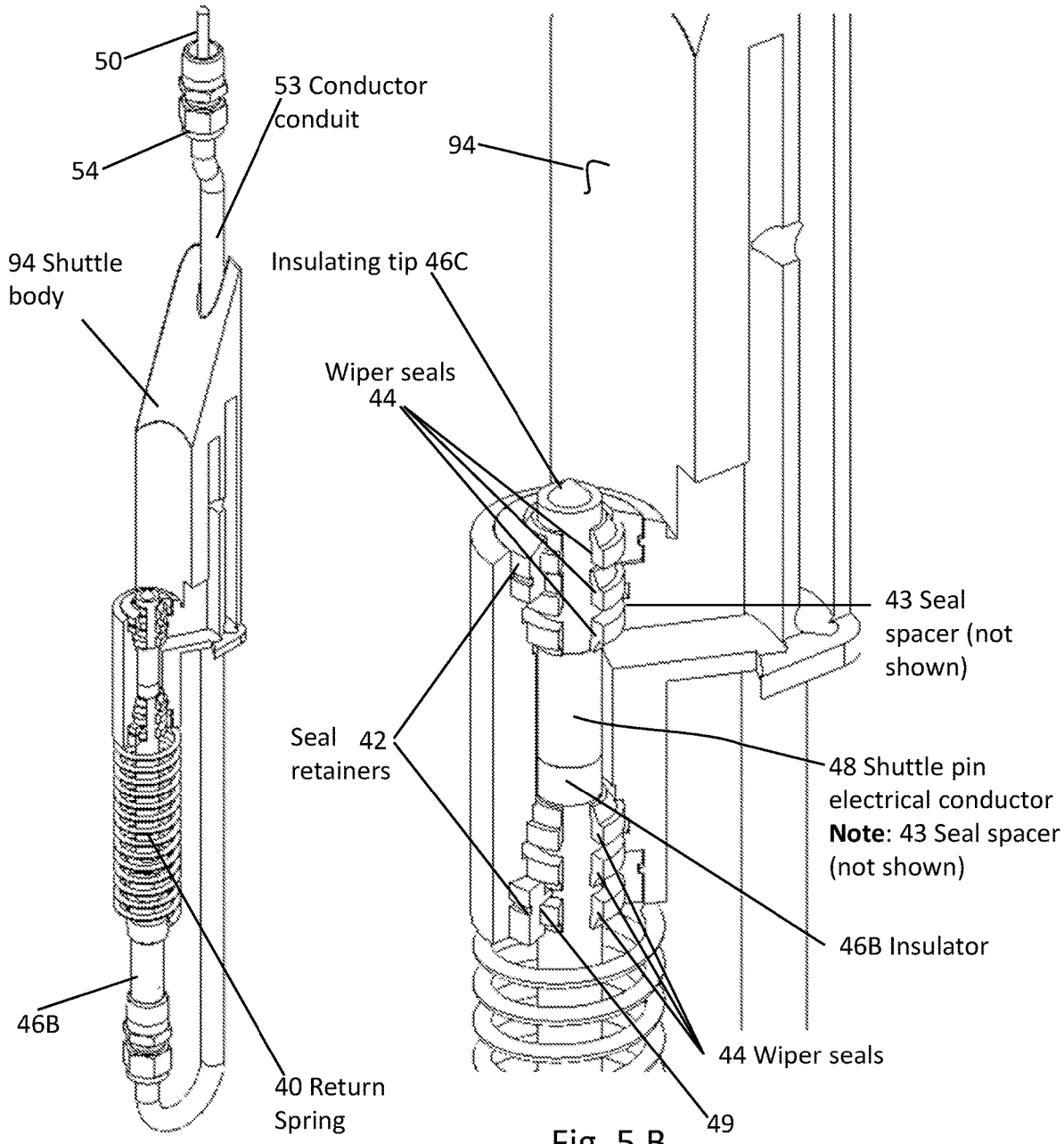

FIG. 5 A is a sketch of a shuttle and conductor conduit assemblies and FIG. 5 B is a sketch of the expanded view of the shuttle and conductor assemblies. The shuttle assembly comprises an outer body and wiper seals as detailed in the views. The shuttle body has an internal flow path that is filled with heavy dielectric fluid. The path is open to the well bore and provides the pressure equalization during operation. Demonstrated references and their inter-configurations are: a return spring 40; a seal retainer 42; a seal spacer 43; a wiper seals 44; an insulator 46B and an insulator tip 46C; an electrical contact 48; a non-conductive travelling pin 49 with top head 49A; a conductor 50; a conduit 53; a conduit fitting 54; and a Shuttle body 94.

The cylindrical body of the shuttle is positioned inside the inside diameter of the docking station with its outside diameter tangential to the inside diameter of the main tubular section of the docking station. The shuttle pin is positioned at the center of this cylindrical body. The wedge-shaped abutment is positioned in a pocket that extends outward from the outside diameter of the docking station main tubular section. There is a cylindrical path cut through the wedge-shaped section of the shuttle body that ends at the top of the wedge on one end and at the center of the cylindrical body on the other end. The path will be filled with high specific gravity dielectric fluid that insulates the high voltage electrical connection from ground. The wiper seals are centrally positioned in the cylindrical body of the shuttle. The wiper seals create a fluid seal between the shuttle body and the shuttle pin. During mating of the connector, the shuttle body is pushed along an axial path that is coincident with the shuttle pin axis. The wiper seals will wipe the surface of the shuttle pin during this motion. In one embodiment of this invention there are three wiper seals at the top of the shuttle body and three wiper seals at the bottom of the shuttle body. Two wiper seals are directed outward and one wiper seal is directed inward at each end of the shuttle pin. The shuttle pin comprises an electrical conductor, an insulating tip, a conductor guide tube, an electrical terminal, and an insulator. The insulating tip is at the top of the shuttle pin. Prior to mating the insulating tip protrudes from the top of the shuttle body and is joined (threaded connection) to the conductor below the top set of wiper seals. The insulating tip is made of a high resistivity material. The top of the insulating tip 49C is cone shaped to facilitate mating with the non-conductive travelling pin 49 of the female connector. The conductor is a cylindrical rod with a step change in the outside diameter. The electrical contact area has an outside diameter that is equal to the insulating tip. The conductor outside diameter steps down such that the conductor is inside the insulator. The bottom of the conductor is fastened to an electrical terminal (threaded or soldered). The insulator is positioned between the conductor and the conductor conduit. The top of the insulator is above the top of the conductor conduit. The bottom of the insulator is positioned inside the conductor conduit. The insulator is made of a high resistivity material. The insulator is tubular with a stepped outside diameter. The outside diameter of the top of the tube is equal to the conductor and insulator tip outside diameters. The inside diameter is equal to the stepped down outside diameter of the conductor. The outside diameter of the bottom of the insulator is equal to the inside diameter of the conductor conduit. The conductor conduit is a corrosive resistant tube that is positioned between the shuttle body and the mounting ledge in the docking station. The top of the conductor conduit is above the lower seal set inside the shuttle body. The bottom of the conductor conduit is fastened to the mounting ledge with a tubing fastener (Swagelock or equivalent). The return spring is placed between the shuttle body and the mounting ledge in the docking station. The return spring is made of a corrosion resistant material. The return spring provides the force to return the shuttle body to its unmated position within the docking station pocket. The electrical connection from the bottom of the mounting ledge to the top of the connector pocket is facilitated by a conductor conduit. The conductor conduit comprises an outer tube, an electrical conductor and insulation material. The conductor conduit outer tube of the conductor conduit is a corrosion resistant material and is connected to the bottom of the shuttle pin mounting ledge and to the top of the pocket in the docking station. The conductor conduit is a U-shaped configuration with the mounting ledge connection below the top of pocket connection. The connections at each end are facilitated by tubing fasteners (Swagelok or equivalent). The electrical conductor is inside the conductor conduit tube. The electrical conductor may be a highly conductive metal with insulation material separating it from the outer tube or may be a wire that is held in the tube with an epoxy or elastomeric material. The conductor has an electrical terminal connection at each end.

Figures 6A, 6B:
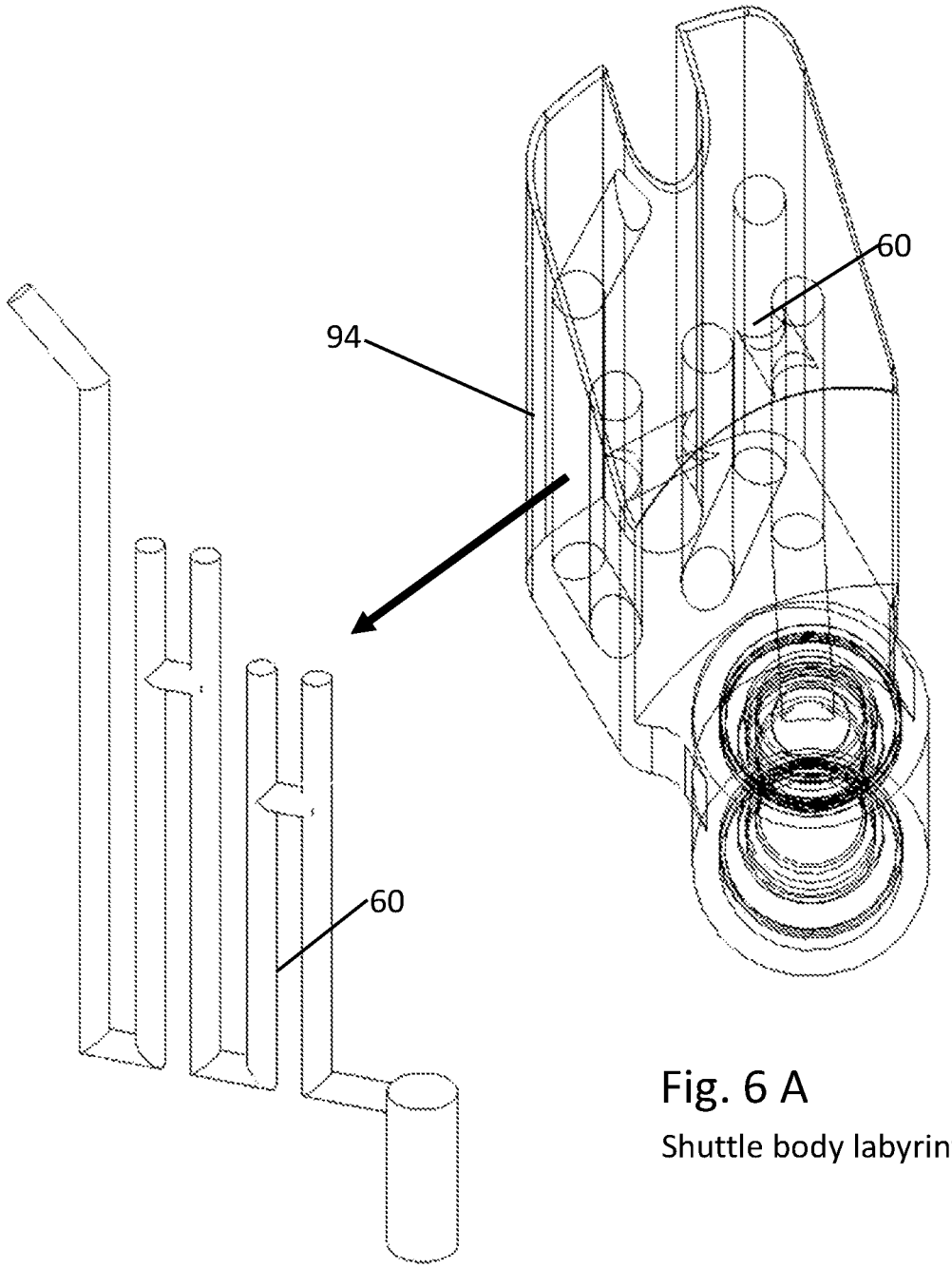
Figure 6C:
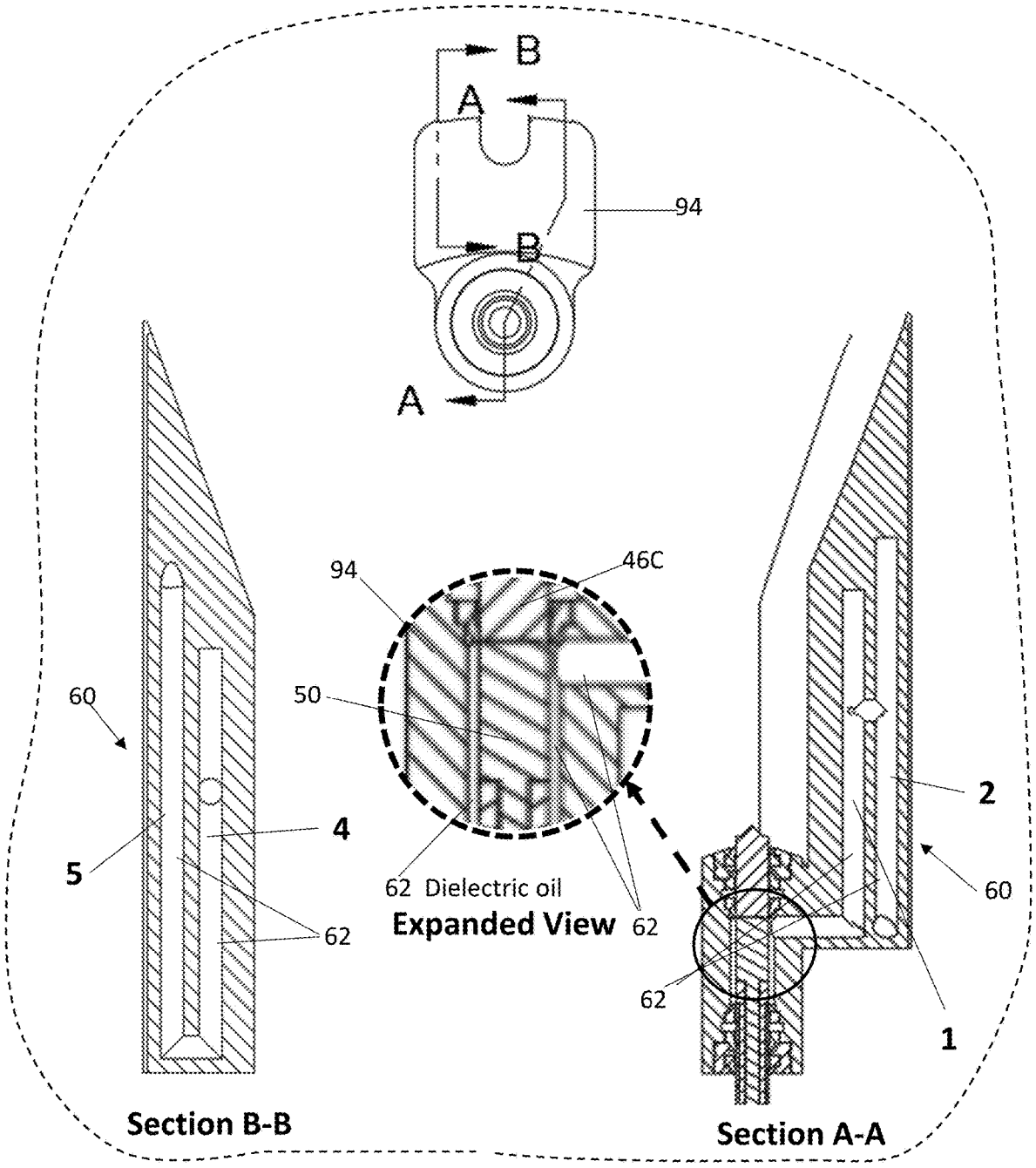
Figure 6D:
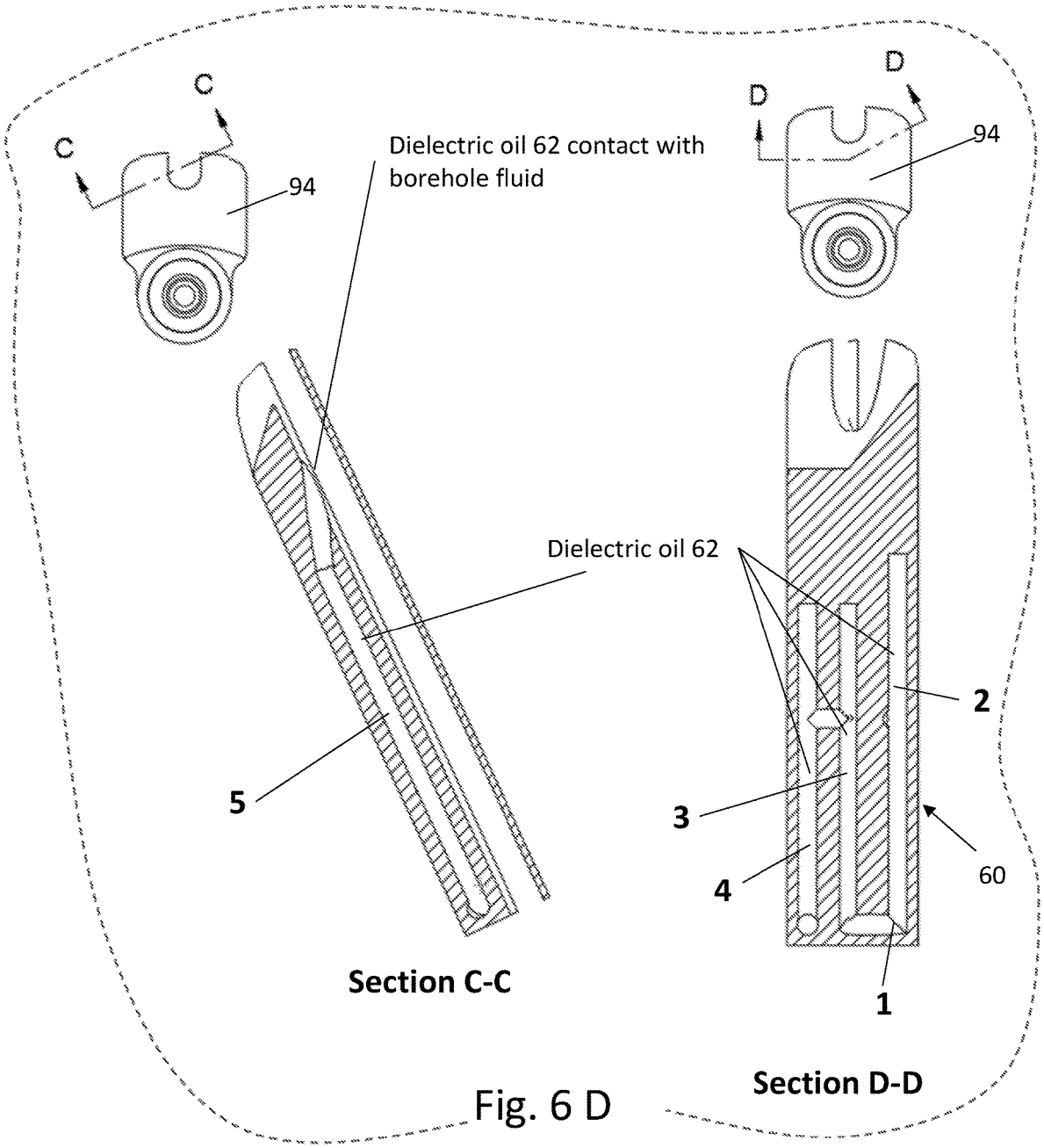

FIG. 6 A is a sketch of a shuttle body labyrinth path, FIG. 6 B is a sketch of a flat pattern of internal labyrinth path, and FIGS. 6 C and 6 D are sketches of the Male Wet Mate Connector Dielectric Oil Path. Here the labyrinth path of the fluid in the shuttle body is shown. This path allows for trapping the well bore fluids that may penetrate the shuttle body due to temperature fluctuations. In these views are shown the following references and their configurations: an insulator tip 46C; electrical conductor 50; a labyrinth path 60; a dielectric fluid 62; and a Shuttle body 94.

Figure 7A:
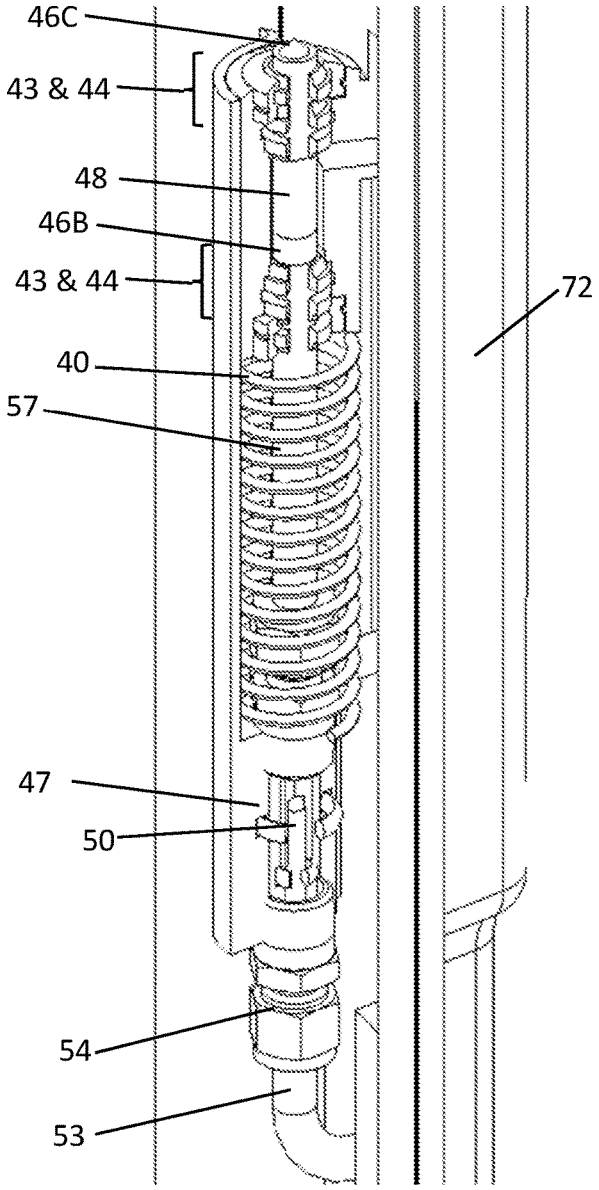
Figure 7B:
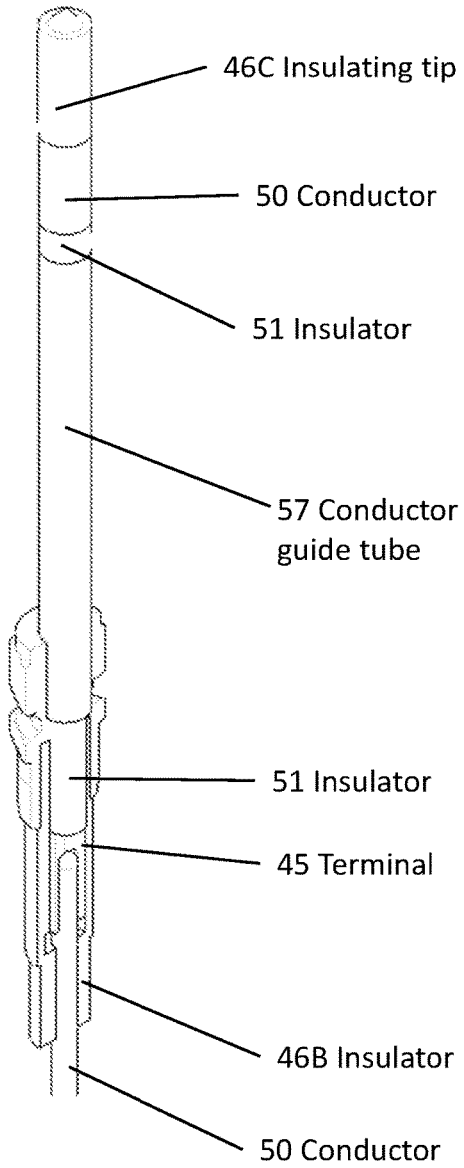

FIG. 7 A is a sketch of a shuttle pin assembly in the conductor housing and FIG. 7 B is a shuttle pin assembly. The shuttle body moves along the shuttle pin assembly that is shown here. The shuttle pin comprises a conductor, a ceramic insulating tip, a guide tube, and an insulator. The bottom wiper seals of the shuttle assembly will travel along the guide tube as the male connector mates with the female connector. These references include: a return spring 40; a seal spacer 43; a wiper seals 44; a terminal 45; an insulator 46B and an insulator tip 46C; an O-ring 47; an electrical contact 48; a conductor 50; a conductor 50; an insulator 51; a conduit 53; a conduit fitting 54; a conductor guide tube 57; and a docking station tube 71 main body.

Figures 8A, 8B:
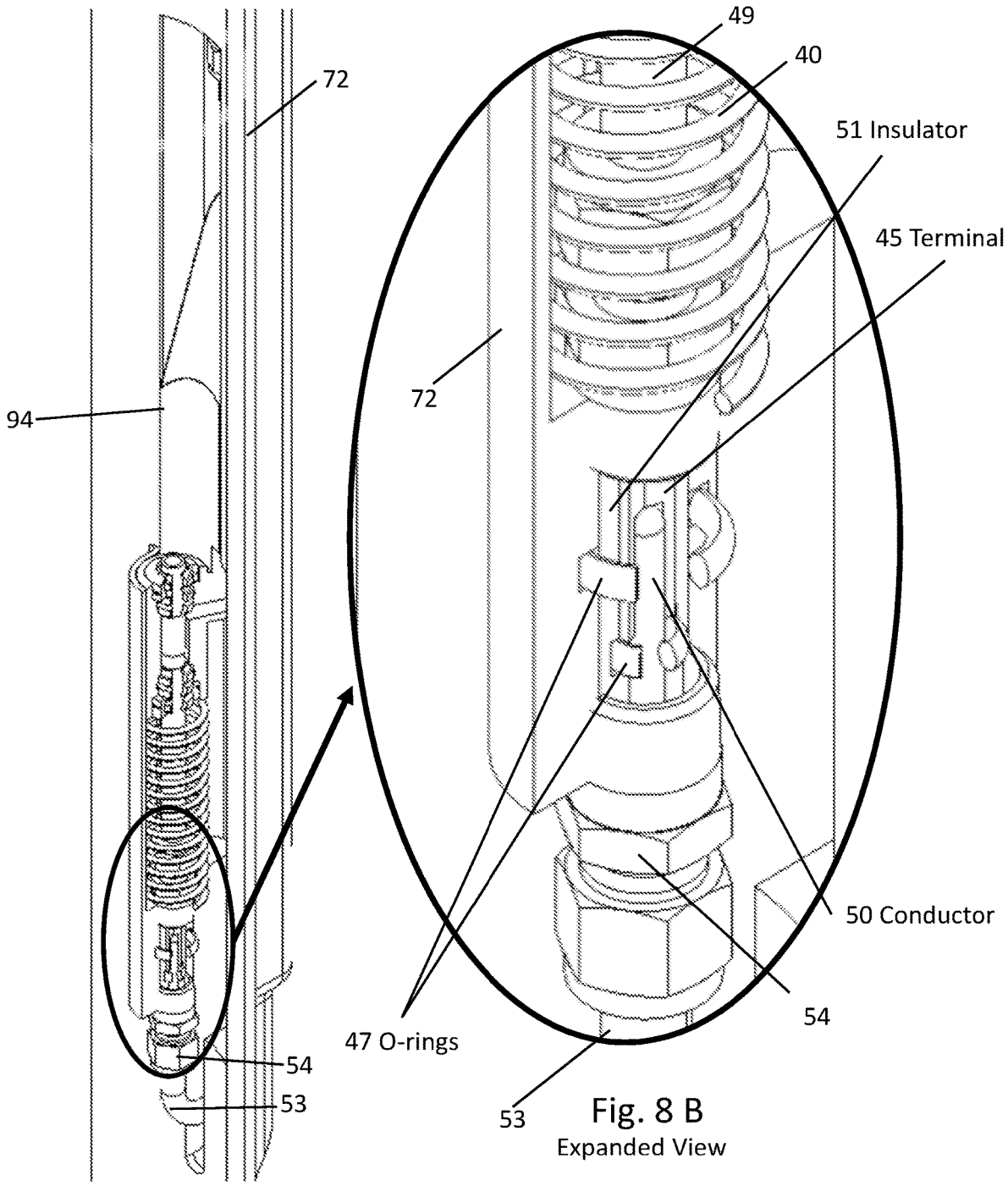

FIG. 8 A is a sketch of a shuttle pin to conductor conduit connection and FIG. 8 B is an expanded view of the shuttle pin to conductor connection. The shuttle pin assembly is connected to the conductor conduit assembly as shown. The conductor conduit assembly comprises an outer tube, a conductor and insulating material. Demonstrated here are: a return spring 40; a terminal 45; an O-ring 47; a conductor 50; an insulator 51; a conduit 53; a conduit fitting 54; a male wet mate connector housing 72; and a Shuttle body 94.

Figure 9:
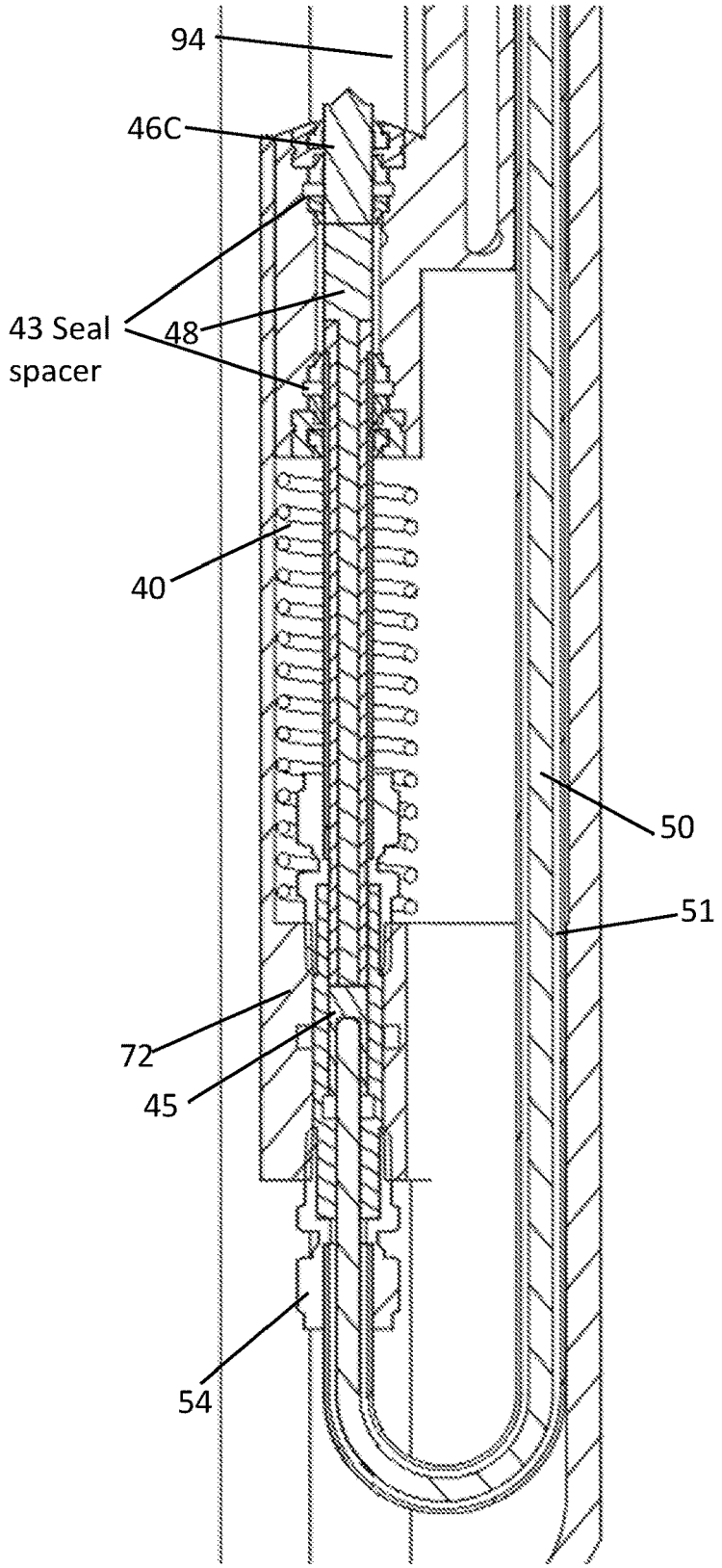
FIG. 9 is a sketch of a male, inline wet mate connector cross section.
Figure 10:
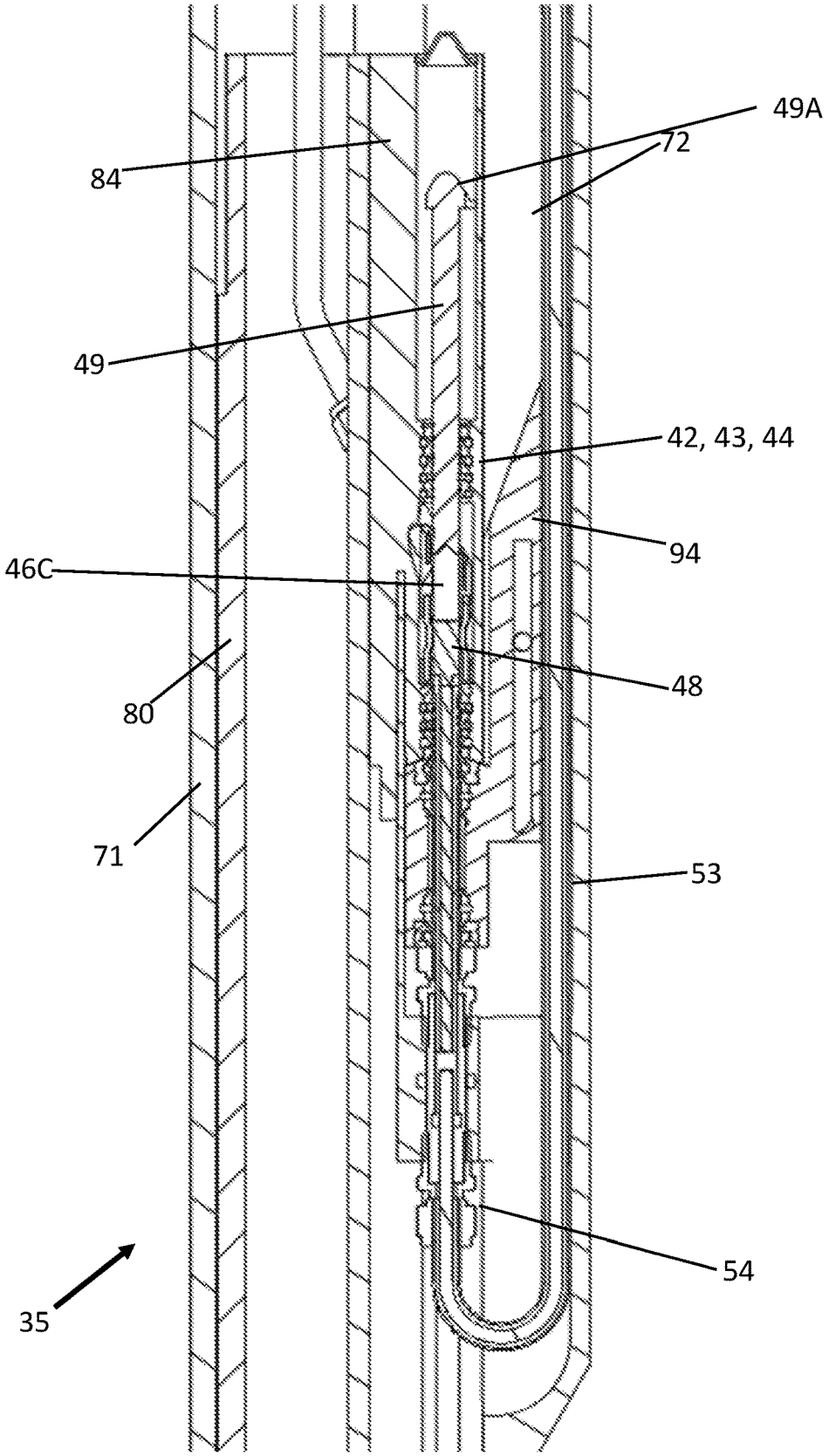
FIG. 10 is a sketch of the male and female mated connectors cross section.
Figure 11A:
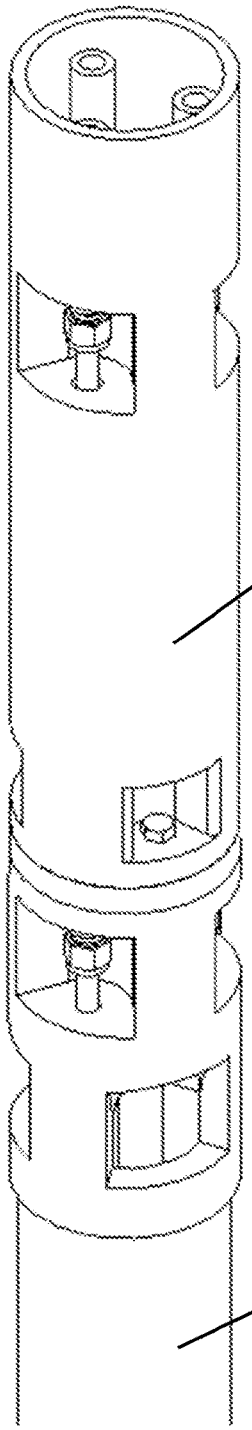
Figure 11B:
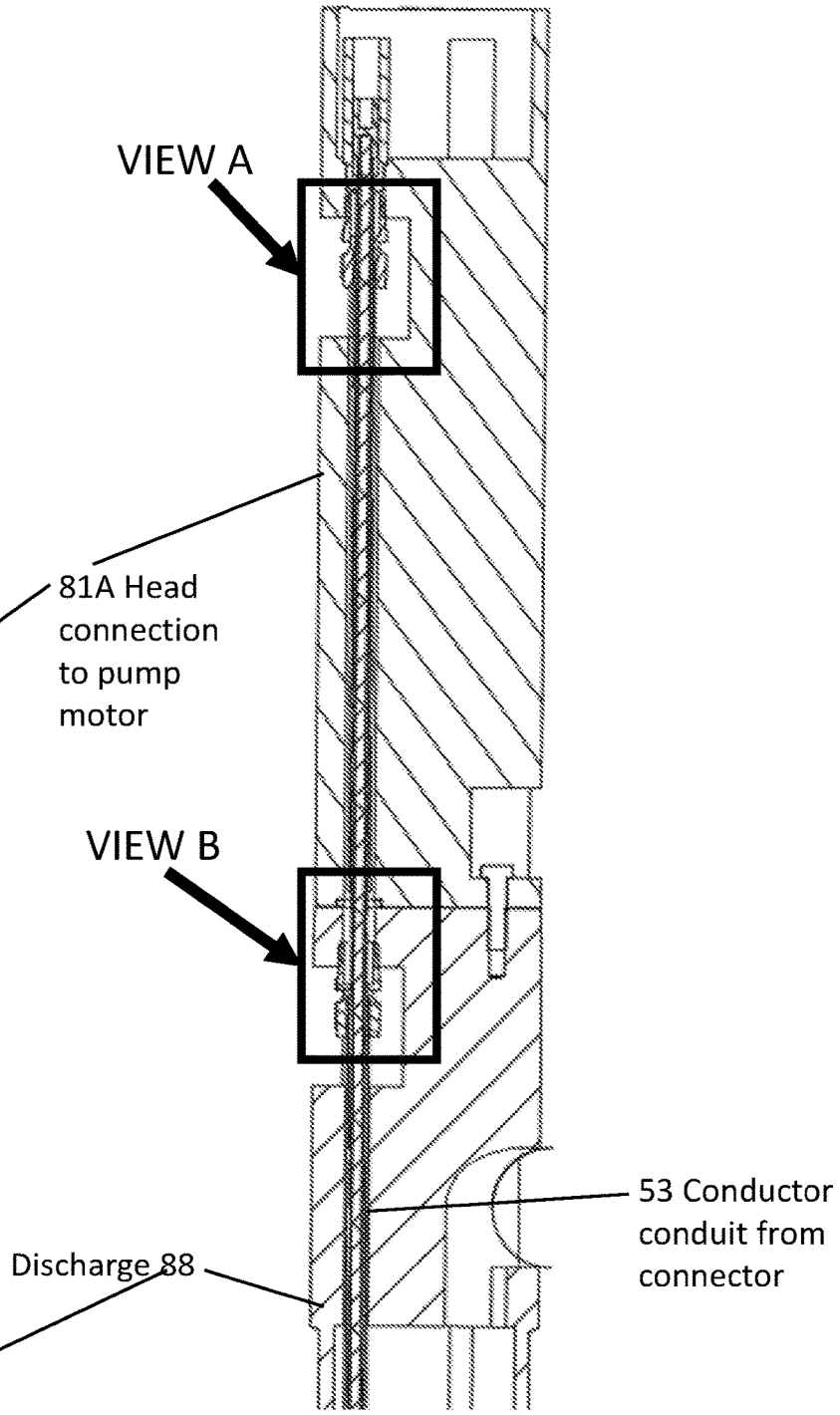
Figure 11B:
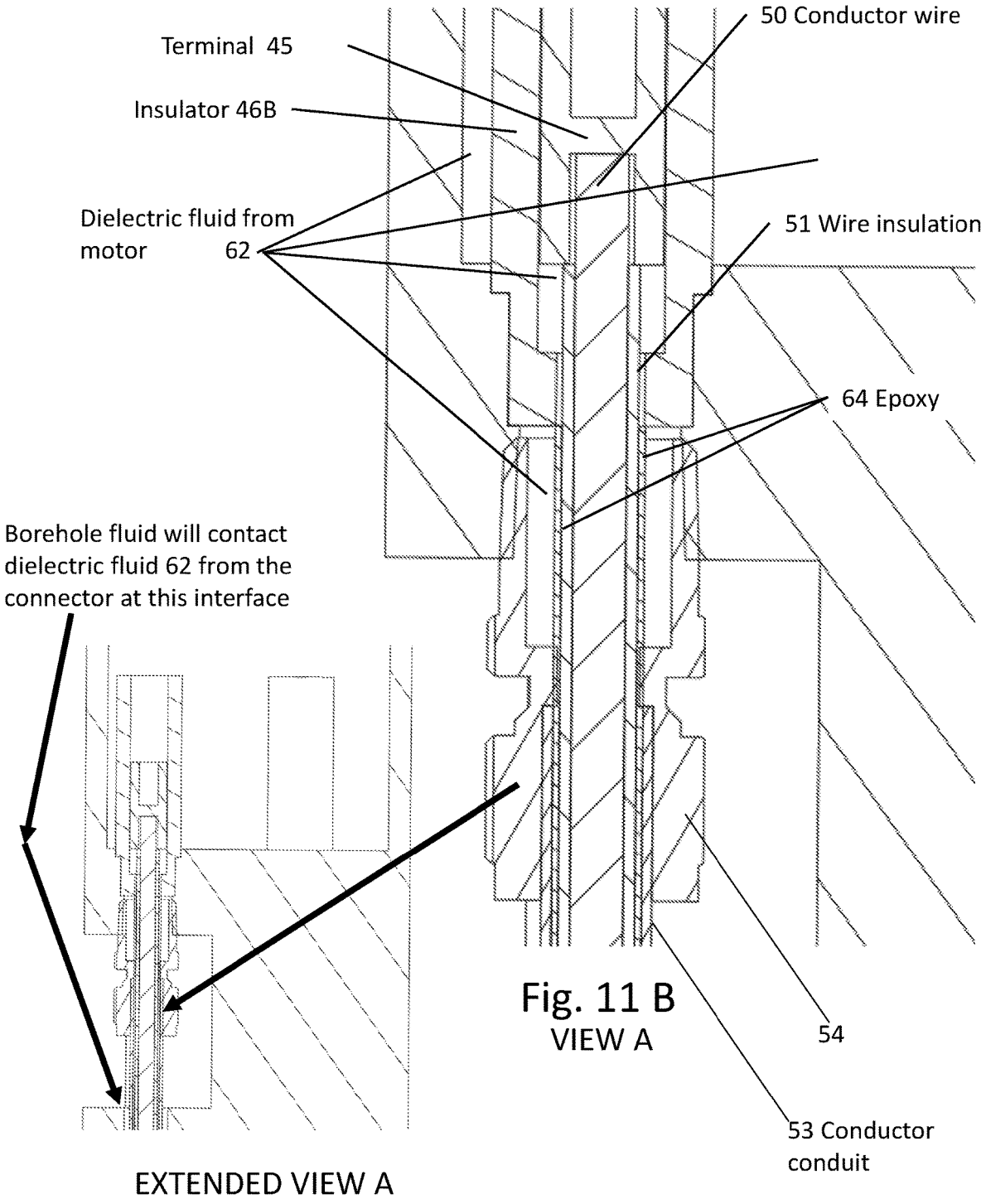
Figure 11B:
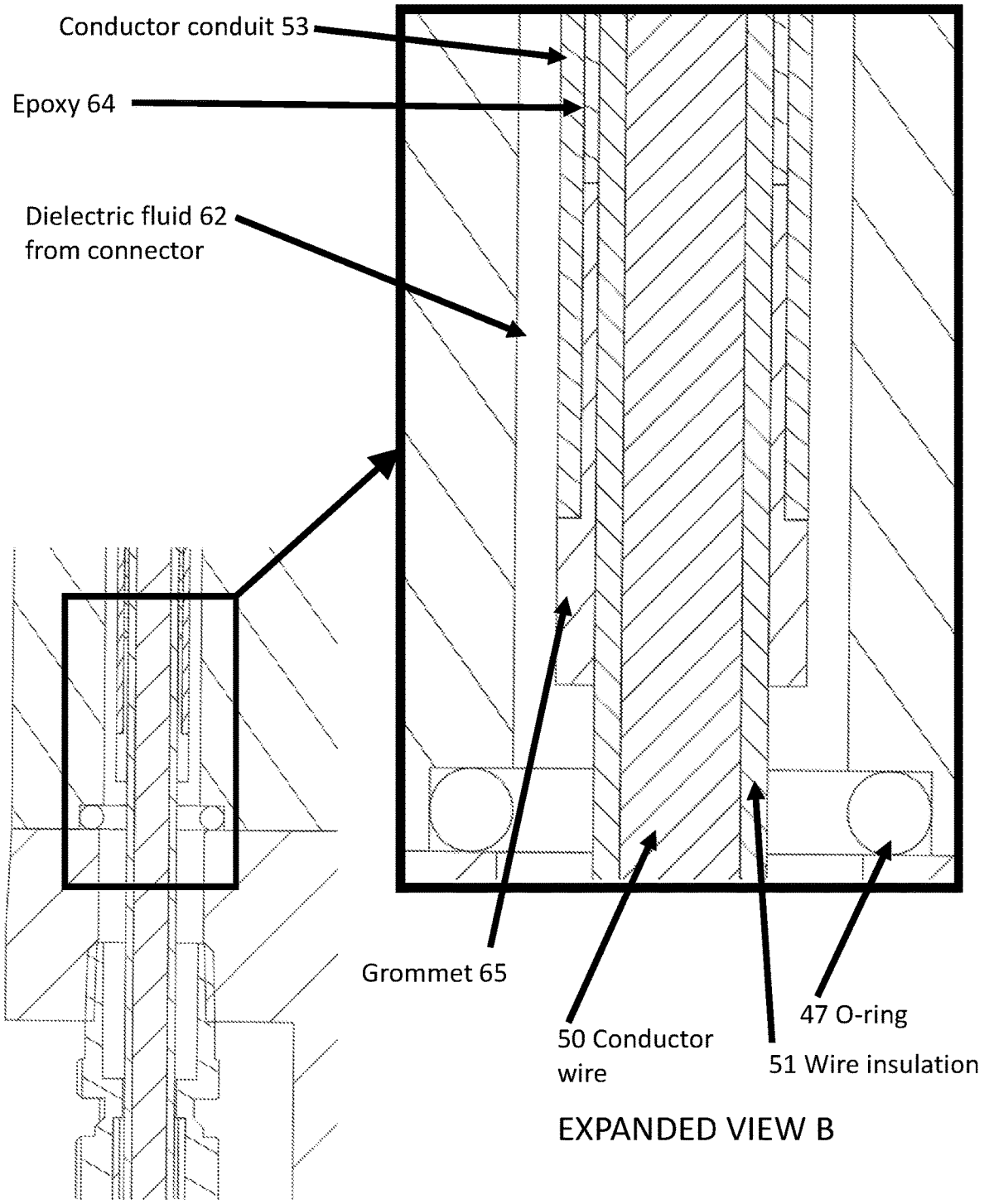
Figure 12A:
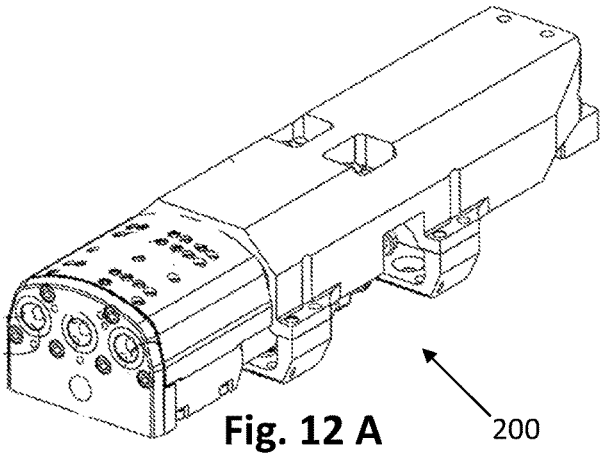
Fig. 12 A Prior Art
Figure 12B:
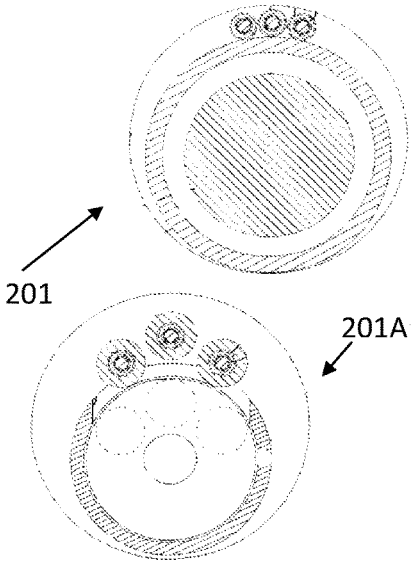
Fig. 12 B Prior Art
Figure 12C:
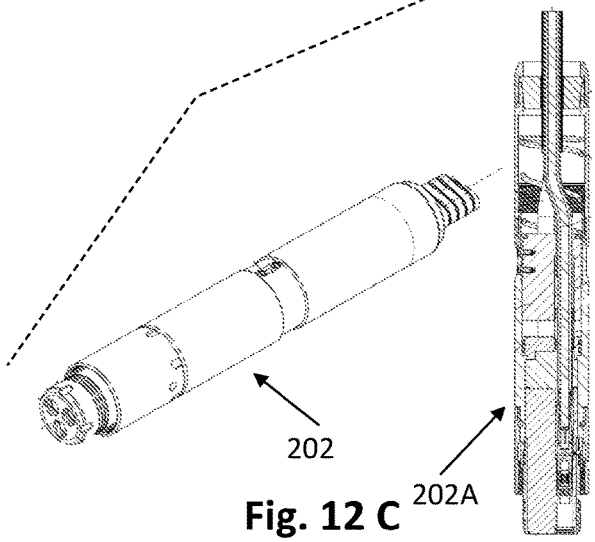
Fig. 12 C Prior Art
Figure 12D:
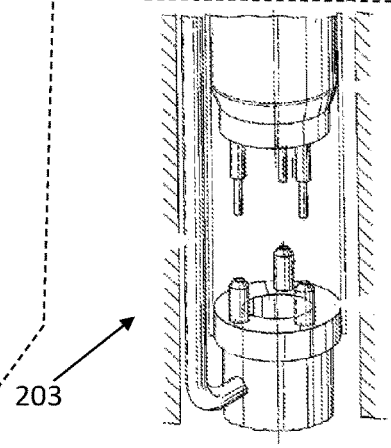
Fig. 12 D Prior Art
Figure 12E:
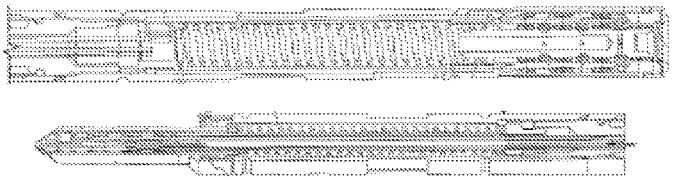
Fig. 12 E Prior Art
Figure 12G:
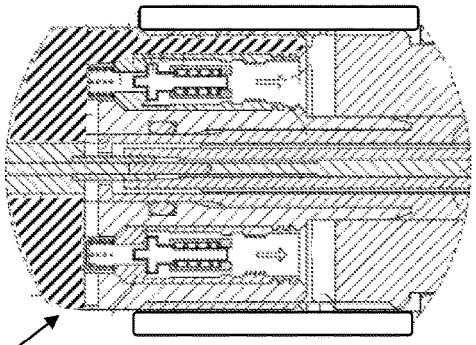
Fig. 12 G Prior Art
Figure 12F:
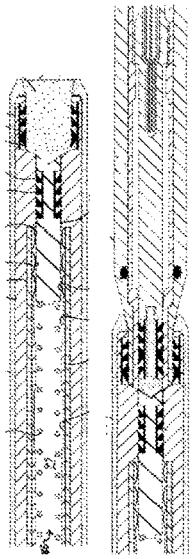
Fig. 12 F Prior Art
Figure 12H:
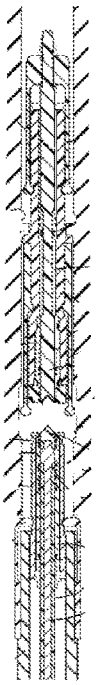
Fig. 12 H Prior Art
Figure 12I:
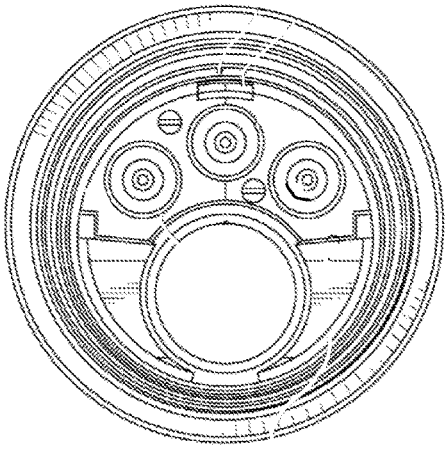
Fig. 12 I Prior Art

FIG. 9 is a sketch of a male, inline wet mate connector cross section. FIG. 10 is a sketch of the male and female mated connectors cross section. These are discussed in the Operations Section, below.

FIGS. 11 A and 11 B with the several views are schemes for alternative pressure balance configuration 58 of closely fitting components for the dielectric fluids with cross sections and expanded views. Seen here are: a terminal 45; an insulator 46B; an O-ring 47; a conductor 50; an insulator 51; a conduit 53; a conduit fitting 54; a dielectric fluid 62; an epoxy 64; a grommet 65; an electric submersible motor (ESP) 81; connection head 81A for motor 81; and a discharge point/port 88. In this alternative embodiment of this invention the dielectric fluid from the ESP will not be in direct contact with the dielectric fluid in the lower conductor conduit. There is a discontinuity in the conductor conduit that creates an upper and lower conductor conduit. In this alternative embodiment of this invention, the lower conductor conduit will be open to the borehole fluid. The electrical conductor will be sealed at the entry to the head. The lower conductor conduit will be filled with a heavy dielectric fluid that is in contact with the dielectric fluid in the wet mate connector. The heavy dielectric fluid will form the barrier between the borehole fluid and the electrical connection in the wet mate connector. In this alternative embodiment, the pressure balance between the external borehole fluid and the internal dielectric fluid of the female connector is facilitated by a direct contact between the external borehole fluid and the dielectric fluid of the female wet mate connector. In this embodiment, the female wet mate connector is filled with a high specific gravity dielectric fluid. The specific gravity of the fluid is significantly greater than the maximum borehole fluid. The dielectric fluid fills the internal cavity of the female wet mate connector and the annular space between the conductive wire and the conductor conduit tube. The conductor conduit terminates at the top of the discharge body of the motor connector. The head comprises a main body, terminals and insulators, a conductor conduit, grommets, and O-rings. In this embodiment, the main body is cylindrical with three holes through the length of the body. The conductor conduits are positioned inside the body. The conduits are connected to the upper portion with a tube fitting and do not extend to the bottom of the body. The discontinuity of the conductor conduit facilitates the passage of dielectric fluid from inside the lower conductor conduit to the annular space between the outside of the upper conductor conduit and the larger diameter through hole. Near the top of the upper conductor conduit the large diameter through hole has an opening to the borehole fluid. The conductor wire is positioned inside the conductor conduit. The bottom of the conductor conduit is sealed with a grommet and the annular space between the conductor wire and the conductor conduit is filled with epoxy. The heavy dielectric fluid 62 in direct contact with the borehole fluid creates the pressure balanced environment between the internal cavity of the wet mate connector and the borehole fluid while also electrically isolating the connection between the male and female wet mate connectors.

FIGS. 12 A through 12 I are sketches of prior art. Here former patents and applications for oil well electrical connections and deployment schemes. These include: a prior art 200 U.S. Pat. No. 9,028,264—Downhole Electrical Connector—2015—Head; a prior art 201—U.S. Pat. No. 8,746,354—Wet Connection System For Downhole Equipment—2014—Head; a prior art 202—U.S. Pat. No. 10,276,969—Connector w/Sealing Boot & Moveable Shuttle—2019—Campbell; a prior art 203—U.S. Pat. No. 7,533,461—Method for Interconnecting Conduits In a Borehole—20009—Griffiths; a prior art 204—U.S. Pat. No. 9,270,051—Wetmate Connector—2016—Christianson et al; a prior art 205—U.S. Pat. No. 9,546,527—Wet Connection System for Downhole Equipment—2017—Head; and Prior Art 208—U.S. Pat. No. 11,021,939—System and method related to pumping fluid in a borehole 2021—Crowley, et al. As can be seen, the Electric Submersible Pump (ESP) Rig Less Deployment Method and System 30 for Oil Wells and the deployment and the wet mate connector 35 and the like are a unique combination and use as described herein.

The anticipated durable materials for the Wet Mate Connector for an Electric Submersible Pump (ESP) 35 include: a 316, 410 or 420 stainless steels; high temperature (greater than 200 degrees Celsius) elastomeric such as FFKM and FKM (fluorocarbon rubber polymers, Fluro-Elastomer) and TFE/P (a copolymer of tetrafluoroethylene and propylene with a fluorine content of approximately 54%); insulators of 450 polyether ketone polymer (PEK); ceramic insulator materials and composite materials.

The details mentioned here are exemplary and not limiting. Other specific components and manners specific to describing a Wet Mate Connector for an Electric Submersible Pump (ESP) may be added as a person having ordinary skill in the field of the art of oil well electrical connections for downhole electrical connections and devices and their uses well appreciates.

Operation of the Preferred Embodiment

The Wet Mate Connector for an Electric Submersible Pump (ESP) 35 has been described in the above embodiment. The manner of how the device operates is described below. One notes well that the description above and the operation described here must be taken together to fully illustrate the concept of the wet mate connector 35. The preferred embodiment of a wet mate connector system that provides a pressure compensated environment for an inline electrical connection contact is comprised of: a). a set of several, at least one, but normally at least three inline male connectors, each connector that is static and remains in a borehole; b). a set of at least three inline female connectors, each connector that is moveable and is mounted on a motor connector that is part of the electric submersible pump (ESP) assembly; and c). each of the static male connectors further comprises a shuttle body, a shuttle pin, a return spring, and a conductor conduit, wherein the shuttle body comprises a series of wiper seals separated by seal spacers and a top and bottom seal retainer, wherein the top and bottom seal retainer are sealed to the shuttle body with an O-ring, and wherein the shuttle body profile includes a cylindrical body with a wedge-shaped abutment and which said cylindrical body contains the top and bottom seal retainer, the wiper seals and seal spacers wherein within the wet mate connector system, the shuttle pin is positioned at the center of this cylindrical body, and the cylindrical body of the shuttle is positioned inside the inside diameter of the docking station with its outside diameter tangential to the inside diameter of the docking station.

FIG. 9 is a sketch of a male, inline wet mate connector cross section. Shown here are: a return spring 40; a seal spacer 43; a terminal 45; an insulator tip 46C; an electrical contact 48; a conductor 50; an insulator 51; a conduit fitting 54; a dielectric fluid 62; a male wet mate connector housing 72; and a Shuttle body 94.

FIG. 10 is a sketch of the male and female mated connectors cross section. Viewed in these are: a Wet Mate Connector 35 for an Electric Submersible Pump (ESP); a return spring 40; an insulator tip 46C; an electrical contact 48; a non-conductive travelling pin 49 with top head 49A; a conduit 53; a conduit fitting 54; a dielectric fluid 62; a docking station tube 71 main body; a male wet mate connector housing 72; a motor connector string 80; a female wet mate connectors 84 housing on motor connector 80; and a Shuttle body 94.

The operation of a Wet Mate Connector for an Electric Submersible Pump (ESP) is as described in the following. In the process of mating the connectors the female connectors of the motor connector, which is mated to the ESP, will be lowered into the borehole and a suitable orientation method will align the axes of the travelling pin of the female connector and the shuttle pin assembly of the male connector. As the ESP/motor connector assembly continues to be lowered in the well the housing of the male connector slides into an aligning groove of the female connector. This creates the final alignment accuracy. The conical tip of the insulating pin of the male connector will be inserted into the concave conical feature of the travelling pin. The housing of the female connector will then contact the body of the male shuttle assembly. The male shuttle assembly will travel along the guide tube of the shuttle pin assembly and compress the return spring of the male connector. As the shuttle body is travelling along the guide pin the shuttle pin assembly will be pushed into the female connector pushing the travelling pin out of the top of the connector and compressing the return spring of the female connector. The shuttle pin assembly will push past the wiper seals in the female connector to eliminate the intrusion of well bore fluids during the mating operation. As the connectors reach the final mating position the conductor of the shuttle pin assembly will be in contact with the electrical contact of the female connector.

Throughout the mating operation the pressure in the male and female connectors will be balanced with the fluid pressure in the borehole. The pressure balance in the male connector is maintained by means of a labyrinth fluid path from the cavity surrounding the shuttle pin to an opening that is in direct contact with the borehole fluid. The labyrinth path (FIG. 6) is filled with a dielectric fluid that has a specific gravity greater than the fluid in the borehole. The labyrinth path is a small diameter circular path that limits the contact area between the fluids to reduce dispersion. In addition, the labyrinth path has chambers that are oriented such that they will be at a higher elevation than the cavity surrounding the shuttle pin when the connector is positioned in the well. These chambers will allow any borehole fluid that penetrates the labyrinth to be isolated.

The pressure balance of the female connector in the preferred embodiment will utilize the pressure balance method of the ESP. The typical ESP string will have a protector mounted above the motor of the ESP. The protector uses either a labyrinth path or elastomeric bags to maintain a fluid pressure equilibrium between the borehole fluid and the dielectric fluid in the ESP. In the preferred embodiment the female wet mate connectors will be connected to the bottom of the motor and the dielectric fluid will flow from the wet mate connectors to the motor in the electrical conductor conduit of the female connectors. In an alternate embodiment the motor connector could use the same labyrinth fluid path pressure balance technique that is embodied in the shuttle body of the male wet mate connector. The pressure balance technique that embodies a high specific gravity and labyrinth fluid path could also be employed for the pressure balance of the ESP.

The de-mating of the connectors is performed in the reverse of the mating operation. The return spring of the female connector ensures that contact between the travelling pin and shuttle pin assembly will be maintained as the pins pass the wiper seals. The return spring of the male connector will return the shuttle assembly to the original unmated position with the conductor protected by the dielectric fluid.

With this description it is to be understood that the details shown here are not to be limited to only the disclosed embodiment of product. Other specific components and manners specific to describing a Wet Mate Connector for an Electric Submersible Pump (ESP) may be added as a person having ordinary skill in the field of the art of oil well electrical connections for downhole electrical connections and devices and their uses well appreciates. The features of the wet mate connector 35 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications, and equivalents that come within the spirit of the disclosures described heretofore and or/defined by the following claims are desired to be protected.

What is claimed is:

1. A wet mate connector system for a docking station of an oil well that provides a pressure compensated environment for a connection of a set of stationary male connectors and a set of movable female connectors and said wet mate connector system is made of durable materials and is comprising:

a). the set of stationary male connectors including at least three inline male connectors mounted on an inside of the docking station which has an inside and outside diameter and an inside surface and an outside surface, wherein each of the inline male connectors is mounted having its outside diameter tangential to the inside diameter of the docking station, and wherein each of the male connectors is static and remains in a borehole incorporating a first pressure balance system comprising a high specific gravity dielectric fluid and labyrinth path; and b). the set of movable female connectors including at least three inline female connectors, each female connector is moveable, is mounted on a motor connector that is part of an electric submersible pump (ESP) assembly, and comprises a second pressure balance system wherein the second pressure balance system incorporates the pressure compensated dielectric fluid from the ESP pressure compensation system or incorporates a high specific gravity dielectric fluid and a labyrinth path wherein the wet mate connector system makes an electrical connection in an underground borehole that provides for the transmission of electric power from a power supply to the motor of an electric submersible pump (ESP) and provides a balance of pressure between an internal dielectric fluid that isolates the electric connection and the external borehole fluid.

2. The wet mate connector system in claim 1 wherein each of the static male connectors further comprises a shuttle body with a profile, a shuttle body, a return spring, and an assembly of a conduit and conductor.

3. Each of the static male connectors of the wet mate connector system in claim 2 wherein the shuttle body with a profile comprises a series of wiper seals separated by a series of seal spacers, a top and a bottom seal retainer.

4. Each of the static male connectors of the wet mate connector system in claim 3 wherein the shuttle body profile includes a cylindrical body with a wedge-shaped abutment with an internal labyrinth passage of the first pressure balance system that connects an inner profile to the external well bore and is filled with a high specific gravity dielectric fluid providing a barrier to a well bore fluid and a pressure balance between the well bore fluid and the dielectric fluid.

5. Each of the static male connectors of the wet mate connector system in claim 4 wherein said cylindrical body contains both the top and the bottom seal retainers, the wiper seals, and the seal spacers.

6. Each of the static male connectors of the wet mate connector system in claim 5 wherein the cylindrical body of the shuttle is positioned inside an inside diameter of the docking station with its abutment outside diameter tangential to the inside diameter of a pocket of the docking station.

7. Each of the static male connectors of the wet mate connector system in claim 6 wherein the shuttle pin is positioned at the center of this cylindrical body.

8. The female wet mate connector system in claim 1 wherein the second pressure balance of pressure compensated environment is selected from the group consisting of pressure compensated dielectric fluid from the ESP and an alternative pressure balance configuration comprising a high specific gravity dielectric fluid and labyrinth path.

9. The wet mate connector system in claim 8 wherein the alternative pressure balance configuration is comprising an insulator, an O-ring, and an epoxy configured to seal edges and surfaces of an insulator, an electrical contact, a conductor, an insulator, a conduit, and a conduit fitting and to prevent leakage of a dielectric fluid between the internal dielectric fluid and the external borehole fluid.

10. The wet mate connector system in claim 1 wherein the durable material is selected from the group consisting of 316 stainless steel, 410 stainless steel, 420 stainless steel, greater than 200 degrees Celsius capable elastomeric fluorocarbon rubber polymer, greater than 200 degrees Celsius capable elastomeric Fluro-elastomer, 450 polyether ketone polymer, a copolymer of tetrafluoroethylene and propylene with a fluorine content of approximately fifty-four percent (54%), and composite materials.

11. The wet mate connector system in claim 1 wherein the at least one female connector comprises an electric contact, a conductor, a set of insulators, a travelling pin, a wiper seals, a return spring, a pair of seal retainers, and a profile and dielectric oil that communicates to an ESP motor sealing system through a conductor conduit.

12. A wet mate connector system for a docking station of an oil well that provides a pressure compensated environment for a connection of a set of stationary male connectors and a set of movable female connectors and said wet mate connector system is made of durable materials and is comprising:

a). the set of at least three stationary male connectors, each connector that is static and remains in a borehole;

b). the set of at least three movable female connectors, each connector that is moveable and is mounted on a motor connector that is part of the electric submersible pump (ESP) assembly; and c). each of the static male connectors further comprises a shuttle body with a profile, a shuttle pin, a return spring, and a conductor conduit, wherein the shuttle body comprises a series of wiper seals separated by seal spacers and a top and bottom seal retainer, wherein the top and bottom seal retainers are sealed to the shuttle body with an O-ring, and wherein the shuttle body profile includes a cylindrical body with a wedge-shaped abutment and which said cylindrical body contains the top and bottom seal retainers, the wiper seals and seal spacers wherein within the wet mate connector system, the shuttle pin is positioned at the center of this cylindrical body, and the cylindrical body of the shuttle is positioned inside the inside diameter of the docking station with its outside diameter and tangential to the inside diameter of the docking station wherein the wet mate connector system makes an electrical connection in an underground borehole that provides for the transmission of electric power from a power supply to the motor of an electric submersible pump (ESP) and provides a balance of pressure between the internal dielectric fluid and the external borehole fluid.

13. The wet mate connector system in claim 12 wherein each of the at least three inline female connectors comprises an electric contact, a conductor, insulators, a travelling pin, wiper seals, a return spring, seal caps, a profile and a pressure compensation that is selected from the group consisting of pressure balanced fluid from the ESP motor or the alternative pressure balance configuration comprising high specific gravity dielectric fluid in a labyrinth path providing a barrier between the well bore fluid and pressure balance between the well bore fluid and the dielectric fluid.

14. The wet mate connector system in claim 13 wherein the alternative pressure balance configuration is comprising an insulator, an O-ring, and an epoxy configured to seal edges and surfaces of an insulator, an electrical contact, a conductor, an insulator, a conduit, and a conduit fitting and to prevent leakage of a dielectric fluid between the internal dielectric fluid and the external borehole fluid.

15. The wet mate connector system in claim 12 wherein the durable material is selected from the group consisting of 316 stainless steel, 410 stainless steel, 420 stainless steel, greater than 200 degrees Celsius capable elastomeric fluorocarbon rubber polymer, greater than 200 degrees Celsius capable elastomeric Fluro-elastomer, 450 polyether ketone polymer, a copolymer of tetrafluoroethylene and propylene with a fluorine content of approximately fifty-four percent (54%), and composite materials.

* * * * *